US005329799A

United States Patent [19]

Ito et al.

[11] Patent Number: 5,329,799

[45] Date of Patent: Jul. 19, 1994

[54] PROCESS AND APPARATUS FOR PRESS-FORMING TUBULAR CONTAINER-LIKE ARTICLE FROM STRIP, INCLUDING FORWARD AND BACKWARD IRONING STEPS

[75] Inventors: Norio Ito, Toyota; Koichi Mine, Aichi, both of Japan

[73] Assignee: Toyota Jidosha Kabushiki Kaisha, Aichi, Japan

[21] Appl. No.: 67,050

[22] Filed: May 25, 1993

[30] Foreign Application Priority Data

May 29, 1992 [JP] Japan ..... 4-163521
May 29, 1992 [JP] Japan ..... 4-163522

[51] Int. Cl.[5] ..... B21D 22/24

[52] U.S. Cl. ..... 72/340; 72/349; 72/379.4

[58] Field of Search ..... 72/340, 344, 348, 349, 72/379.4

[56] References Cited

U.S. PATENT DOCUMENTS

| | | |
|---|---|---|
| 1,200,593 | 10/1916 | Currie . |
| 1,524,183 | 5/1924 | Knaebel . |
| 1,638,995 | 8/1927 | Hodge . |
| 1,665,203 | 4/1928 | Delf . |
| 2,611,475 | 9/1952 | Slater . |
| 3,820,368 | 6/1974 | Fukuzuka et al. . |
| 3,855,862 | 12/1974 | Moller . |
| 4,217,770 | 8/1980 | Wassen . |
| 4,346,580 | 8/1982 | Saunders . |
| 4,457,150 | 7/1984 | Saunders et al. . |
| 4,541,265 | 9/1985 | Dye et al. . |
| 4,962,659 | 10/1990 | Imazu et al. . |
| 5,179,854 | 1/1993 | Matsui et al. . |

FOREIGN PATENT DOCUMENTS

| | | |
|---|---|---|
| 172376 | 9/1952 | Austria . |
| 0005084 | 10/1979 | European Pat. Off. . |
| 0017434A1 | 10/1980 | European Pat. Off. . |
| 45115 | 2/1982 | European Pat. Off. . |
| 0118926 | 9/1984 | European Pat. Off. . |
| 298560A | 1/1989 | European Pat. Off. . |
| 0425704A1 | 5/1991 | European Pat. Off. . |
| 1602538 | 3/1970 | Fed. Rep. of Germany . |
| 2758254A1 | 5/1979 | Fed. Rep. of Germany . |
| 2387706 | 12/1978 | France . |
| 045182 | 12/1978 | Japan . |
| 57-11733 | 1/1982 | Japan . |
| 59-29770 | 8/1984 | Japan . |
| 60-3923 | 1/1985 | Japan . |
| 248520 | 10/1988 | Japan ..... 72/349 |
| 547263 | 4/1977 | U.S.S.R. . |
| 1140258 | 1/1969 | United Kingdom . |
| 1229475 | 4/1971 | United Kingdom . |
| 1540031 | 2/1979 | United Kingdom . |
| 2010720A | 7/1979 | United Kingdom . |
| 2071546A | 9/1981 | United Kingdom . |

OTHER PUBLICATIONS

"Pressing and Die Technique", first edition, first print, Nikkan Kogyo Shinbunsha, Aug. 30, 1990, p. 85.

*Primary Examiner*—Lowell A. Larson
*Attorney, Agent, or Firm*—Finnegan, Henderson, Farabow, Garrett & Dunner

[57] ABSTRACT

Method and apparatus for pressing a sheet blank into a tubular container, including a first process or device for drawing the blank into an intermediate workpiece having a tubular portion and a bottom portion closing one end of the tubular portion, and a second process or device for ironing the tubular portion in the axial direction. The second process includes a forward ironing step for placing the workpiece on a first ironing punch and forcing the workpiece and first punch together into a first die hole, to iron the tubular portion in an axial direction from the above one end toward the other end, and a backward ironing step for placing the workpiece on a columnar second ironing punch and forcing the workpiece and second punch together into a second die hole, with a columnar pushing punch held in pressing contact with the outer surface of the bottom portion of the workpiece, to iron the tubular portion in the direction opposite to that in the forward ironing step.

24 Claims, 12 Drawing Sheets

| | BLANKING | FIRST DRAWING | SECOND DRAWING | THIRD DRAWING | FOURTH DRAWING | FORWARD IRONING | BACKWARD IRONING | IRONING COINING |
|---|---|---|---|---|---|---|---|---|
| PROCESS STEPS | $\phi D$, $t_0$ | $d_1$ | $d_2$ | $d_3$ | $d_4$ | $d_5$ | $d_6$ | $d_7$ |
| DIE CLEARANCE | — | 1.08 $t_0$ | 0.91 $t_0$ | 0.94 $t_0$ | 1.08 $t_0$ | — | — | — |
| IRONING PERCENT | — | — | — | — | — | 8.9% | 7.5% | 8.3% |

| | BLANKING | FIRST DRAWING | SECOND DRAWING | THIRD DRAWING | FOURTH DRAWING | FORWARD IRONING | BACKWARD IRONING | IRONING COINING |
|---|---|---|---|---|---|---|---|---|
| PROCESS STEPS | $\phi D$, $t_0$ | $d_1$ | $d_2$ | $d_3$ | $d_4$ | $d_5$ | $d_6$ | $d_7$ |
| DIE CLEARANCE | — | 1.08 $t_0$ | 0.91 $t_0$ | 0.94 $t_0$ | 1.08 $t_0$ | — | — | — |
| IRONING PERCENT | — | — | — | — | — | 8.9% | 7.5% | 8.3% |

FIG. 1

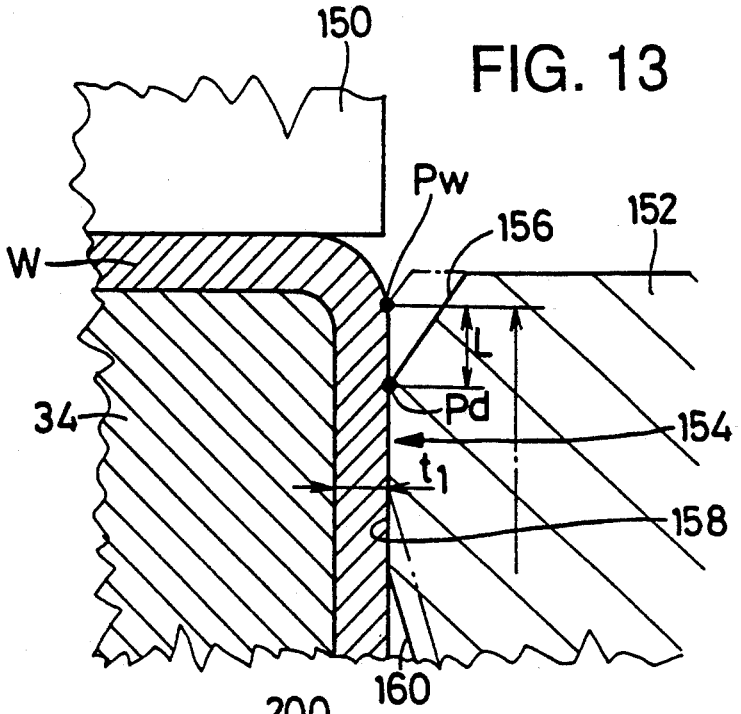
FIG. 13
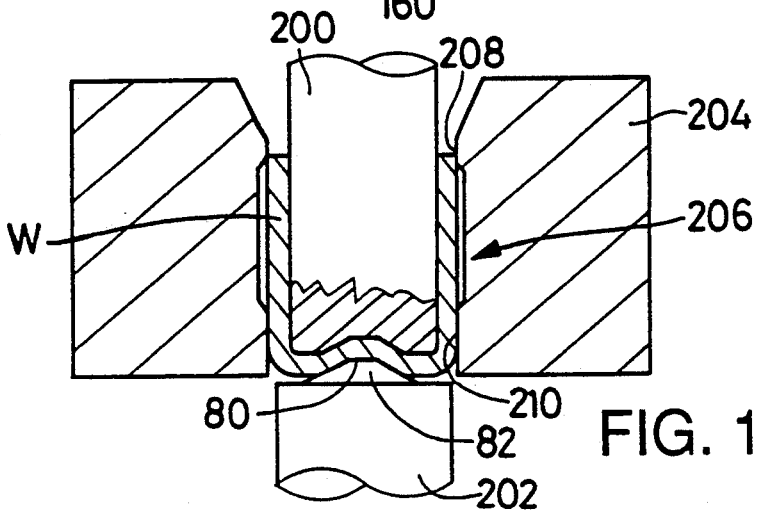
FIG. 14
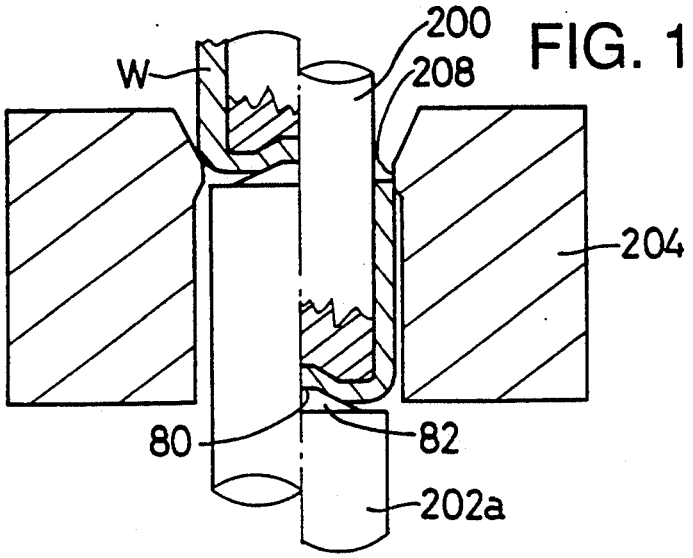
FIG. 15
FIG. 16
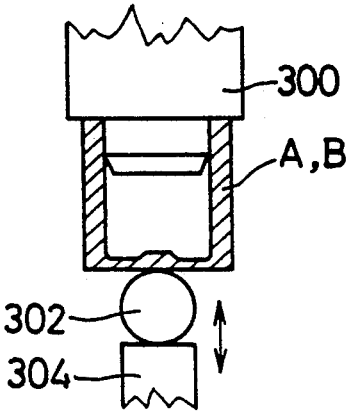

| LEGEND | TESTPIECE | TEMPERATURE |
|---|---|---|
| □ | A | 350 ℃ |
| ■ | B | 350 ℃ |
| ◇ | A | 500 ℃ |
| ◆ | B | 500 ℃ |

FIG.18
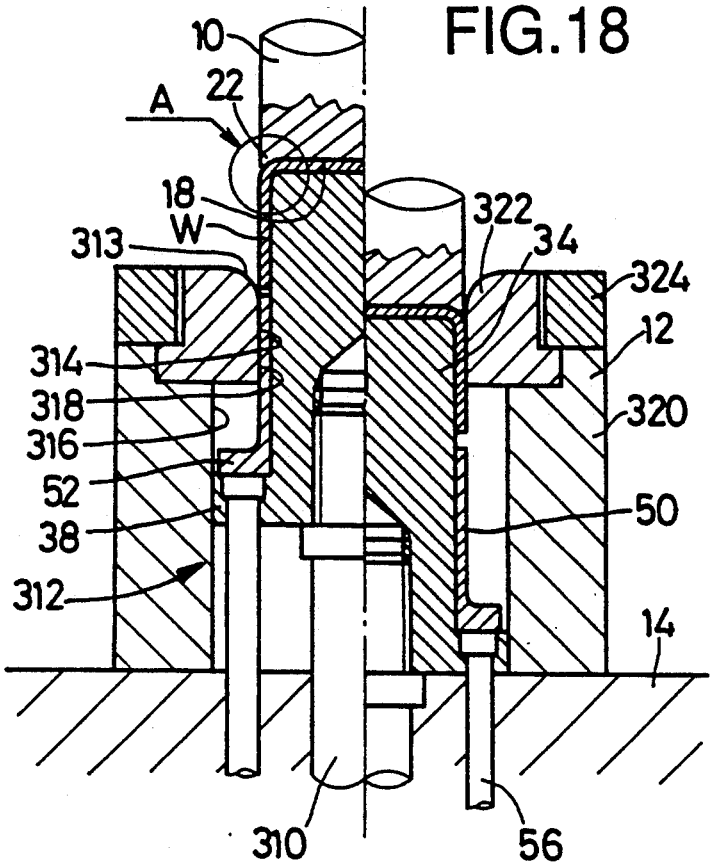
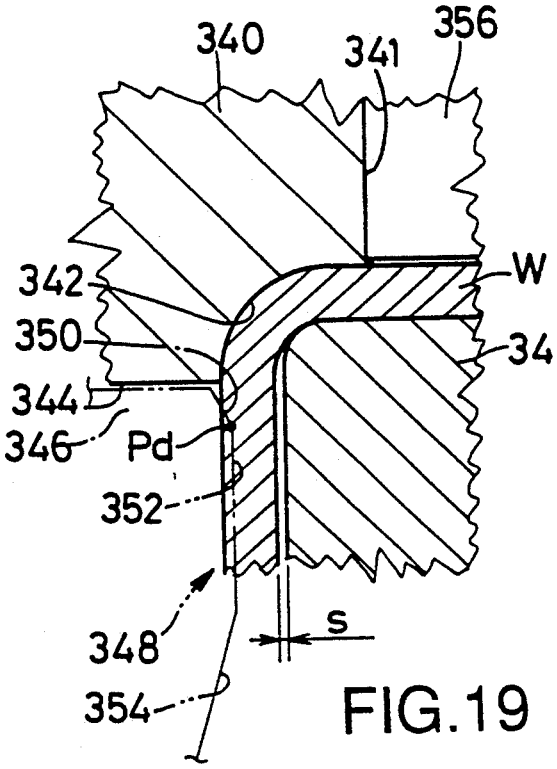
FIG.19
FIG.20
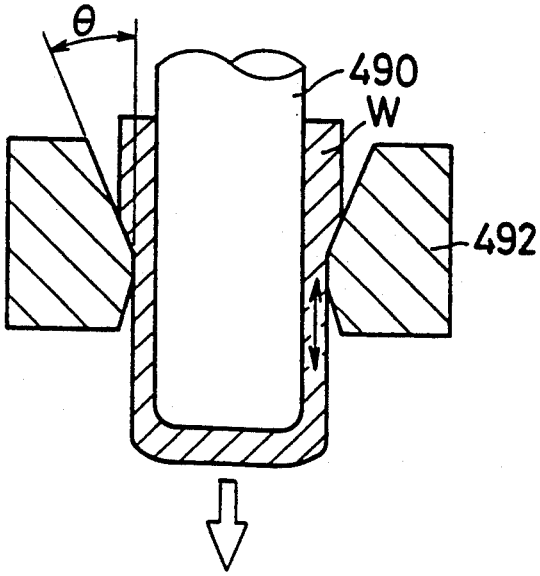

PROCESS AND APPARATUS FOR PRESS-FORMING TUBULAR CONTAINER-LIKE ARTICLE FROM STRIP, INCLUDING FORWARD AND BACKWARD IRONING STEPS

BACKGROUND OF THE INVENTION

1. Field of the Invention

The present invention relates in general to a method and an apparatus for pressing a sheet-like blank into a tubular or cylindrical container-like article. More particularly, the present invention is concerned with such pressing method and apparatus wherein a backward ironing step is effected on an intermediate workpiece prepared from the blank, such that the tubular portion of the workpiece is ironed in an axial direction from one axial end at which the tubular portion is open, toward the other axial end at which the tubular portion is closed by the bottom portion. The direction of ironing in the backward ironing step is opposite to that of the conventional forward ironing..

2. Discussion of the Related Art

Generally, a pressing operation to form a tubular container-like article from a sheet-like blank includes a step of drawing the blank into a tubular form having a tubular portion and a bottom portion which closes one of opposite axial ends of the tubular portion. The term "tubular" used herein is interpreted to mean cylindrical and other shapes such as polygons in transverse cross section of an intermediate workpiece or a final product in the form of a container, taken in a plane including the center line of the workpiece or product parallel to the axial or longitudinal direction.

Usually, the wall thickness of the tubular portion of the drawn article does not have a sufficiently high degree of uniformity in the axial direction. In some cases, therefore, the drawn article cannot be used as a final product or article of manufacture in the form of a tubular container, and is generally subjected to a further process step or steps such as an ironing operation performed on the tubular portion of the intermediate workpiece.

As shown in FIG. 20 by way of example, a conventional, widely known ironing process includes the steps of placing a cylindrical intermediate workpiece (blank) W on a columnar or cylindrical ironing punch 490 such that the leading end portion of the punch 490 is positioned within the cylindrical workpiece, and forcing the workpiece W and the punch 492 together into a hole of a die 302, in the axial direction with the bottom portion of the workpiece leading the punch 492, so that the cylindrical portion of the workpiece is ironed in the direction from the closed axial end toward the open axial end.

Commonly, the ironing operation indicated above follows the drawing operation, to obtain a sufficiently high degree of uniformity of the wall thickness of the tubular portion of the drawn workpiece, and improve the internal and external dimensions and shapes of the workpiece or article.

The assignee of the present invention developed a backward ironing process, and a device suitable for performing the backward ironing process, as disclosed in examined Japanese Utility Model Application published under Publication No 59-29770. This backward ironing device will be described by reference to FIG. 21, wherein the left half of the view shows an operating state of the device immediately after a backward ironing action is started, while the right half shows an operating state of the device immediately after the backward ironing action is terminated.

The backward ironing device is provided with a pushing punch 500 and a die 502. The pushing punch 500 is reciprocated in the longitudinal direction by a suitable drive device, the detailed discussion of which is not deemed necessary to understand the backward ironing device. The pushing punch 500 has a flat lower end face. The die 502 has a stepped die hole 504 formed therethrough, and is fixedly mounted on a base 508.

The die hole 504 has an upper small-diameter portion 510, and a lower large-diameter portion 512 having a larger diameter than the small-diameter portion 510. A flanged ironing punch 516 slidably engages the small-diameter portion 510 of the die hole 504, with a flanged sleeve 518 interposed therebetween. The ironing punch 516 is biased by a cushion pin 520, which is movable in the vertical direction. The ironing punch 516 and the sleeve 518 are normally held in their uppermost positions (indicated in the left half of the view of FIG. 21) under the biasing action of the cushion pin 520. In these uppermost positions, an outward flange 522 provided at the lower end of the sleeve 518 is in abutting contact with a shoulder surface of the die hole 504 between the small- and large-diameter portions 510, 512. The sleeve 518 has an axial length suitably determined in relation to the axial or height dimension of the ironed workpiece W. In the present example, the axial length of the sleeve 518 is determined such that the upper end of the sleeve 518 is located at an axially middle portion of the ironing punch 516. In operation, the cylindrical workpiece W is fitted on the upper portion of the punch 516 which is not surrounded by the sleeve 518. The upper portion of the punch cooperates with an ironing surface 523 of the small-diameter portion 512 of the die 502, to iron the cylindrical portion of the workpiece W in the axial direction from the open end toward the closed end, with the workpiece W and punch 516 being moved down relative to the die 502 by the pushing punch 500. The sleeve 518 functions to form the lower open end face of the cylindrical portion of the workpiece, such that the lower end face of the ironed cylindrical portion of the workpiece W is forced against the upper end face of the sleeve 518 immediately before the ironing action is terminated.

The ironing punch 516 and the cushion pin 520 are both hollow members, and an eject pin 524 extends through the bore in the cushion pin 520 and slidably engages the bore in the punch 516. The eject pin 524 is lowered with the workpiece W and punch 516 to the lowermost position (indicated in the right half of FIG. 21) at which the ironing action is terminated. Then, the eject pin 524 is moved up relative to the punch 516, to thereby push up the ironed workpiece W for removal from the punch 516.

There will be described in detail an operation of the backward ironing device of FIG. 21 to iron the workpiece W. The backward ironing operation consists of two major steps, namely, (1) a first step for positioning the workpiece W right above the ironing punch 516, by a gripping finger of a suitable work feed device, pushing the workpiece W on the upper portion of the punch 516 by the pushing punch 520, and forcing down the workpiece W and the punch 516 together into the die hole 504 to thereby iron the cylindrical portion of the workpiece W, and (2) a second step for moving up the pushing punch 520, ironing punch 516, sleeve 518 and workpiece W from the lowermost position (indicated in the right half of the view of FIG. 21), and separating the workpiece W from the ironing punch 516. The first step described above will be referred to as "backward ironing" or "backward ironing action" if appropriate.

Before the backward ironing operation is started, the pushing punch 500 is placed at its rest or non-operated position a given distance above the position indicated in the left half of the view of FIG. 21 at which the backward ironing action is started. In this rest position of the pushing punch 500, the workpiece W held by the gripping finger is positioned right above the upper end face of the ironing punch 516. Then, the pushing punch 500 is lowered from the rest position until the lower end face of the punch 500 comes into abutting contact with the outer surface of the bottom portion of the workpiece W. With a further downward movement of the pushing punch 500, the workpiece W is removed from the gripping finger and placed on the upper end portion of the ironing punch 516 such that the bottom portion of the workpiece W abuts on the upper end face of the ironing punch 516. The pushing punch 500 is further lowered to push down the workpiece W, ironing punch 516, sleeve 518, eject pin 524 and cushion pin 520, as a unit, against the biasing force of the cushion pin 520 acting on the ironing punch 516.

Thus, the workpiece W is lowered with its cylindrical portion being ironed by a cooperative action of the ironing punch 516 and the ironing surface 523 which partially defines the die hole 504. The backward ironing action is terminated when the lower end face of the ironing punch 516 abuts on the upper surface of the base 508. Namely, the base 508 serves as a stop which determines the lowermost position of the punch 516 and the workpiece W at which the backward ironing action is terminated. More precisely, the cylindrical portion of the workpiece W has a comparatively long constant-diameter section, and a comparatively short varying-diameter section which connects the constant-diameter section and the bottom portion of the workpiece W. The upper end of the constant-diameter portion is indicated at Pw in FIG. 22 which is an enlarged view of a part indicated at "A" in FIG. 21. On the other hand, the small-diameter portion 510 of the die hole 504 has a constant-diameter section which serves as the ironing surface 523, and an upper and a lower varying-diameter portions on the opposite sides of the constant-diameter portion. The upper end of the constant-diameter section or ironing surface 523 of the die hole 504 is indicated at Pd in FIG. 23 which is an enlarged view of a part indicated at "B" in FIG. 21. The backward ironing device is arranged so that the lower end face of the ironing punch 516 comes into abutting contact with the upper surface of the base 522 as indicated in the right half of FIG. 21, (1) when the lower end of the cylindrical portion of the workpiece W reaches or passes the lower end of the constant-diameter section (ironing surface 523) of the small-diameter portion 510 of the die hole 504, and (2) when the upper end (Pw) of the constant-diameter section of the cylindrical portion of the workpiece W reaches or passes the upper end (Pd) of the constant-diameter section of the small-diameter portion 510.

During the backward ironing action, the workpiece W is squeezed by the ironing punch 516, die 502 and pushing punch 500 such that the inner surface of the workpiece W is in pressing contact with the outer surface of the punch 516 while the outer surface of the workpiece W is in pressing contact with the ironing surface 523, lower end face of the punch 500, and the upper end face of the sleeve 518. Accordingly, substantially the entire areas of the inner and outer surfaces of the workpiece W are restricted under pressure by the punch 516 and the other members indicated above, so that the workpiece W is formed into a predetermined shape with high accuracy. This ironing action involves a flow of the material of the workpiece W as a result of reduction in the wall thickness of the cylindrical portion, in the axial direction from the open end toward the closed end (bottom portion), and a surplus amount of stock of the material fills a space left defined by the lower end face of the punch 500, the ironing surface 523 and the original outer arcuate contour of the varying-diameter section between the constant-diameter section and the bottom portion of the workpiece W, as indicated in FIG. 23.

Upon completion of a backward ironing pass with the ironing punch 516 abutting on the base 508, the pushing punch 500 is raised, permitting the workpiece W and the ironing punch 516 to be pushed up together by the cushion pin 520, from the lowermost position at right in FIG. 21 to the uppermost position at left in the same figure. The pushing punch 500 is further raised to its rest or non-operated position, while the eject pin 524 is moved up relative to the ironing punch 516, until the upper end of the eject pin 524 is located some distance above the upper end of the punch 516, whereby the workpiece W is removed from the punch 516. The thus ironed workpiece W is then clamped by the gripping finger of the work feed device, and transferred to a next station in the production line in question.

In the conventional forward ironing operation in which the cylindrical portion of the workpiece W is ironed in the axial direction from the closed end (bottom portion) to the open end, as illustrated in FIG. 20, the cylindrical portion of the workpiece W is subject to a compressive stress arises in the circumferential direction, and to a tensile stress in the axial direction. In the backward ironing operation as generally illustrated in FIG. 24, on the other hand, the ironing action proceeds in the axial direction from the open end toward the closed end, with a movement of a pushing punch 500' to force the workpiece W and an ironing punch 516' into a die hole in a die 502'. During the backward ironing operation, compressive stresses arise in the cylindrical portion of the workpiece W, in both the circumferential direction and the axial direction. In other words, only the compressive residual stresses remain within the cylindrical portion of the workpiece W, without a room for a tensile stress arising in the workpiece.

When the conventional forward ironing operation is applied to a workpiece or blank made of a stainless material such as an austenite stainless steel having an unstable austenite phase or a high-strength material such as a high-tensile-strength steel, tensile stresses tend to remain as internal or residual stresses in the cylindrical portion (adjacent the open end, in particular) of the ironed workpiece, and the workpiece tends to relatively easily suffer from aging crack (season crack or delayed crack) in the axial direction beginning at its open end, without external forces acting thereon, when the workpiece is left in the atmosphere for a short time (several minutes to several days). An example of the workpiece suffering from such aging crack is shown in FIG. 25. If the forward ironing operation is applied to a workpiece of an ordinary metal material such as carbon steel, tensile stresses tend to remain in the cylindrical portion (adjacent to the open end in particular) of the workpiece, and the workpiece is likely to undergo strain hardening with a result of increase in the brittleness. In this case, the workpiece easily cracks in the axial direction beginning at its open end of the cylindrical portion.

If the workpiece is subjected to the backward ironing operation in place of the forward ironing operation, on the other hand, compressive stresses necessarily remain in the cylindrical portion (at least at its open end section) of the workpiece, irrespective of the material (stainless steel having an unstable austenite phase, high-strength material, or ordinary metal material), and the ironed workpiece is relatively free from the cracking experienced in the conventional forward ironing operation.

The assignee of the present invention proposed a pressing process as disclosed in the above-identified Publication No. 59-29770, in which the workpiece or blank is subjected first to a drawing operation and then to a backward ironing operation as explained above.

However, the following drawback was found in the proposed pressing process including the drawing and backward ironing operations which are performed in this order.

For improving the uniformity of the wall thickness of the tubular portion of the intermediate workpiece drawn, it is necessary to iron the tubular portion with a considerably high ironing ratio or percent (wall thickness reduction ratio of the ironed workpiece with respect to the thickness before ironing, i.e., thickness of the drawn workpiece). It was found in the case of the backward ironing, however, that the higher the ironing ratio, the higher a possibility of a space being formed at an arcuate inner fillet (inner corner surface) indicated at 528 in FIG. 22 between the bottom and cylindrical portions of the ironed workpiece W, more specifically, between the surface of the fillet corner 528 and the facing surface of the ironing punch 516, as shown in FIG. 23. The formation of such a space (so-called "piping defect") along the inner fillet 528 appears to arise from a material flow of the workpiece W from the constant-diameter section to the varying-diameter section between the constant-diameter section and the bottom portion, whereby the varying-diameter section tends to buckle outwardly at an arcuate outer round (outer corner surface) indicated at 526 in FIG. 22, which corresponds to the inner fillet 528. This buckling causes a space to be formed between the inner fillet 528 and the corresponding corner of the punch 516. Therefore, there is a limitation in the ironing ratio or percent in the backward ironing operation, and the backward ironing operation is not satisfactory for even or uniform wall thickness of the ironed workpiece.

While the backward ironing process is substantially free of cracking of the ironed workpiece as described above, the backward ironing process as performed by the device of FIG. 21 has the following problem.

That is, where there exists a relatively narrow space between the outer round 526 of the workpiece W and the lower end of the pushing punch 500, the formation of a space ("piping defect") along the inner fillet 528 of the workpiece W and the ironing punch 516 is less likely to occur. If the space between the lower end of the punch 500 and the outer round 526 is relatively ample as in the case of FIG. 22, the surplus amount of stock of the workpiece material can be sufficiently accommodated in that ample space. This advantage, however, is provided at an expense of an increased space along the inner fillet 528, which space may easily grow into a defect as indicated at 530 in FIG. 23. This defect 530 is caused by movements of mutually facing masses of the material toward each other at the inner corner 528 of the workpiece W, so as to fill a substantially entire portion of the space originally formed along the inner corner 528.

The above defect 530 is likely to take place if the space between the outer round or corner surface 526 and the end face of the pushing punch 500 is comparatively large, irrespective of the ironing ratio. A considered reason for this phenomenon is that the outer corner surface 526 of the workpiece W is not restricted by the punch 200 and the die 502, and is relatively easily permitted to buckle or bend outwardly of the punch 516, as the material flows from the cylindrical portion toward the bottom portion of the workpiece W in the process of the backward ironing in the same direction as that of the material flow. The buckling at the outer corner surface 526 involves the formation of an inner space along the inner fillet or corner surface 528. Thus, the inner surface of the ironed workpiece W does not accurately follow the profile of the ironing punch 516.

SUMMARY OF THE INVENTION

It is therefore a first object of the present invention to provide a method of pressing a sheet-like blank into a tubular container-like article, which includes a drawing process and an ironing process and which is free of the conventionally experienced drawback due to the material flow during the backward ironing operation.

It is a second object of the invention to provide an apparatus suitable for effecting a backward ironing operation to iron a tubular blank in the axial direction from the open end toward the closed end, which apparatus is free of the conventionally experienced drawback due to the presence of an external space between the outer corner surface of the workpiece and the operating end face of the pushing punch.

It is a third object of this invention to provide a method of ironing a tubular blank in the axial direction from the open end toward the closed end, which method does not suffer the formation of an internal space along the inner corner surface of the ironed workpiece.

The above first object may be accomplished according to one aspect of this invention, which provides a method of pressing a sheet-like blank into a tubular container-like article, including a first process in which the sheet-like blank is drawn into an intermediate workpiece having a tubular portion and a bottom portion which closes one of opposite axial ends of the tubular portion, and a second process in which the tubular portion of the intermediate workpiece is ironed in an axial direction thereof, the second process comprising: a forward ironing step for placing the intermediate workpiece on a columnar first ironing punch such that at least a leading end portion of the first ironing punch is positioned within the intermediate workpiece, and forcing the intermediate workpiece and the first ironing punch together into a first die hole, to iron the tubular portion of the workpiece in an axial direction from the above-indicated one of the opposite axial ends of the tubular portion, toward the other of the opposite axial ends toward the other of the opposite axial ends; and a backward ironing step for placing the intermediate workpiece on a columnar second ironing punch such that at least a trailing end portion of the second ironing punch is positioned within the intermediate workpiece, and forcing the intermediate workpiece and the second ironing punch together into a second die hole, with a columnar pushing punch held in pressing contact at one end thereof with an outer surface of the bottom portion of the intermediate workpiece remote from the trailing end portion of the second ironing punch, to iron the tubular portion of the workpiece in an axial direction from the other of the opposite axial ends of the tubular portion toward the above-indicated one of the opposite axial ends.

In the forward ironing step, there is no risk of the formation of an inner space along the inner corner surface of the ironed workpiece, since the material of the tubular portion flows in the axial direction from the bottom portion toward the open end of the tubular portion. Accordingly, the forward ironing step may be performed with a comparatively high ironing ratio or percent (wall reduction ratio or percent of the tubular portion), and the uniformity of the wall thickness of the ironed tubular portion in its axial direction can be effectively improved. However, the forward ironing operation has a disadvantage that the residual stress within the ironed workpiece tends to be a tensile one (expressed as a positive value in the present disclosure; see the graph of FIG. 4, for example).

The backward ironing step, on the other hand, has a disadvantage that the possibility of formation of an inner space along the inner corner surface of the ironed workpiece increases with an increase in the ironing percent. However, the backward ironing process has an advantage that the residual stress tends to be a compressive one (expressed as a negative value in the present disclosure), whereby there is a reduced risk of aging or delayed crack of the ironed workpiece.

In the light of the above, the pressing method according to the first aspect of this invention does not employ either one of the forward and backward ironing steps, but employs both of these two ironing steps, so that the disadvantages of the two steps are offset by the advantages of these steps. The forward ironing step is effected mainly for the purpose of assuring high uniformity of the wall thickness of the ironed tubular portion of the workpiece, while the backward ironing step is intended to reduce the residual stress value within the ironed workpiece (change the residual stress from the tensile side toward the compressive side). Thus, the present pressing method permits the ironed workpiece to have uniform or constant wall thickness at its tubular portion, with considerably reduced or substantially no residual tensile stress (i.e., with a residual compressive stress), while assuring complete elimination of a defect of the ironed workpiece due to an internal space which would be formed between the inner corner surface of the ironed workpiece and the facing outer corner surface of the second ironing punch after the backward ironing step. Accordingly, the present pressing method assures improved quality of the ironed workpiece or a final article of manufacture obtained from the ironed workpiece.

The forward ironing step may be effected before the backward ironing step, or vice versa, providedthe second process of the pressing method includes these two ironing steps.

It is generally known that the amount of the residual stress value within the drawn workpiece is smaller and the drawn workpiece is less likely to crack when the workpiece is concurrently drawn and ironed, than when the workpiece is simply drawn. It is also recognized that the workpiece subjected to the forward ironing is almost free of the internal space formed between the corner surfaces of the workpiece and the first ironing punch, but the workpiece subjected to the backward ironing may a relatively high possibility of the internal space being formed between the corner surfaces of the workpiece and the second ironing punch. This possibility associated with the backward ironing steps increases with an increase in the ironing percent. For increasing the uniformity of the wall thickness of the tubular portion of the ironed workpiece while avoiding the formation of such internal space, it is desirable that the ironing percent in the forward ironing step be higher than that in the backward ironing step. Further, for perfectly avoiding the formation of the internal space between the corner surfaces of the workpiece and the second ironing punch in the backward ironing step, it is desirable that the uniformity of the wall thickness of the tubular portion ironed in the forward ironing step be sufficiently high in the circumferential direction of the tubular portion as well as in the axial direction. If there were a considerable or extremely large difference in the wall thickness between local areas of the tubular portion at different circumferential positions of the workpiece after the forward ironing step, there would arise a large amount of surplus of the material stock at a local area of the tubular portion in the circumferential direction in the backward ironing step, which results in an increase in the ironing load at that local area, leading to a high possibility of buckling taking place on the workpiece.

In view of the above recognition, it is preferable that the first process of the present method be effected such that the sheet-like blank is ironed while being drawn, and that the forward ironing step in the second process be effected prior to the backward ironing step. In this case, it is desirable that the ironing percent or ratio (i.e., reduction ratio or percent of the wall thickness of the tubular portion) in the forward ironing step be larger than that in the backward ironing step. According to this arrangement, the workpiece subjected to the backward ironing step has a sufficiently high degree of uniformity in the wall thickness of the tubular portion, and is free of the aging crack, even if the workpiece as drawn or ironed in the forward ironing step has a high possibility of aging crack. Further, the finally ironed workpiece is free of a defect due to the internal space which would be formed along the inner corner surface of the workpiece at the end of the backward ironing step.

The ironing ratio in the backward ironing step may be zero or almost zero. In this case, the second ironing punch has an outside diameter smaller than an inside diameter of the tubular portion of the workpiece, so that a clearance is left between the second ironing punch and the tubular portion when the workpiece is fitted on the second ironing punch.

The pressing method according to the invention described above is effectively applicable not only to the blank made of a stainless material having an unstable austenite phase such as austenite stainless steel or a high-strength material such as high-tensile-strength steel, which tends to suffer from aging crack, but also to the blank made of an ordinary metal such as a carbon steel which tends to suffer from axial cracking as caused by strain hardening.

The above second object may be achieved according to a second aspect of this invention, which provides an apparatus for ironing a tubular blank having a tubular portion and a bottom portion which closes one of opposite axial ends of the tubular portion, the apparatus including a columnar ironing punch, a die having a die hole having an ironing surface, and a columnar pushing punch, the ironing punch having an outer surface which cooperates with the ironing surface of the ironing die to iron the tubular portion of the tubular blank in an axial direction of the tubular portion from the other of the opposite ends toward the above-indicated one axial end, such that the tubular blank placed on the ironing punch with at least a trailing end portion of the ironing punch being positioned within the tubular blank is forced together with the ironing punch into the die hole, with the pushing punch held in pressing contact at one end thereof with an outer surface of the bottom portion of the tubular blank remote from the trailing end portion of the ironing punch, wherein the pushing punch has a recess formed in an end face at the above-indicated one end thereof, the recess being defined by a surface which is formed to closely contact the outer surface of the bottom portion of the tubular blank, and a portion of an outer surface of the tubular portion of the tubular blank which is adjacent to the outer surface of the bottom portion.

In the ironing apparatus constructed according to the second aspect of this invention, the surface defining the recess formed in the end face of the pushing punch is shaped to closely contact not only the outer surface of the bottom portion of the blank, but also a portion of the outer surface of the tubular portion of the blank which is adjacent to the outer surface of the bottom portion. According to this arrangement, the space formed between the outer corner surface of the blank and the end face of the pushing punch can be made comparatively small, and the material flow during the backward ironing action is more or less restricted by the surface of the recess, whereby the recess functions to protect the outer corner portion of the blank against outward buckling or bending, thereby preventing the formation of an internal space between the inner corner surface of the blank and the corresponding corner surface of the ironing punch.

Thus, the mere provision of the recess in the operating end face of the pushing punch is effective to prevent the conventionally experienced defect at the inner corner surface of the ironed tubular blank due to the presence of a relatively large external space between the outer corner surface of the blank and the end face of the pushing punch. This advantage is offered by simply modifying the configuration of the conventionally used pushing punch, and this solution does not require a significant increase in the cost of manufacture of the backward ironing apparatus.

Commonly, the tubular portion of the blank includes a constant-diameter section whose diameter is constant in the axial direction, and a varying-diameter section whose diameter varies in the axial direction and which connects the constant-diameter section and the bottom portion. In this case, the surface defining the recess of the pushing punch is formed to closely contact not only the outer surface of the bottom portion of the blank, but also the outer surface of the varying-diameter section of the tubular portion of the blank.

The ironing apparatus constructed as described above is suitably applicable to a blank made of a stainless material having an unstable austenite phase, a high-strength material, or an ordinary metal.

The third object indicated above may be attained according to a third aspect of this invention, which provides a method of ironing a tubular portion of a tubular blank having a bottom portion closing one of opposite axial ends of the tubular portion, by cooperation of an outer surface of an ironing punch and an ironing surface of a die hole, such that the tubular blank placed on the ironing punch is forced together with the ironing punch into the die hole, with a pushing punch held in pressing contact at one end thereof with an outer surface of the bottom portion of the tubular blank remote from the ironing punch, to iron the tubular portion of the tubular blank in an axial direction thereof from the other of the opposite axial ends of the tubular portion toward the one of the opposite axial ends, the tubular portion of the tubular blank including a constant-diameter section whose diameter is constant in the axial direction, and a varying-diameter section whose diameter varies in the axial direction and which connects the constant-diameter section and the bottom portion, the method comprising the step of terminating a movement of the tubular blank and the ironing punch into the die hole before an end of the constant-diameter section on the side of the bottom portion has reached one of opposite axial ends of the ironing surface at which an ironing operation on the tubular portion in the axial direction is initiated.

In the ironing method according to the third aspect of the present invention, the backward ironing action or movement of the tubular blank and the ironing punch into the die hole is terminated before the end of the constant-diameter section of the blank on the side of the bottom portion (i.e., the end of the constant-diameter section which is adjacent to the varying-diameter section) has reached one axial end of the ironing surface of the die hole at which the ironing action is initiated. As long as the above requirement is satisfied, the position at which the backward ironing action is terminated may be suitably determined. This arrangement prevents a defect which may take place at the inner corner surface of the blank which is ironed according to the conventional backward ironing method in which the backward ironing action continues even after the end of the constant-diameter section adjacent to the varying-diameter section has passed the axial end of the ironing end at which the ironing action is started.

The above arrangement does not require any substantive change or modification of the ironing apparatus or a significant increase in the cost of manufacture of the apparatus. The present backward ironing method is also suitably applicable to a blank made of any material.

BRIEF DESCRIPTION OF THE DRAWINGS

The above and optional objects, features and advantages of the present invention will become more apparent by reading the following detailed description of some presently preferred embodiments of the invention, when taken in connection with the accompanying drawings, in which:

FIG. 1 is a view schematically showing process steps of a processing method embodying the present invention;

FIG. 13 is an enlarged view showing parts of the device and the workpiece indicated at "A" in FIG. 12;

FIG. 14 is a front elevational view in cross section showing another form of the ironing and coining device used in a third embodiment of the invention;

FIG. 15 is a front elevational view in cross section showing a further form of the ironing and coining device used in a fourth embodiment of the invention;

FIG. 16 is a fragmentary front elevational view in cross section schematically showing a device for effecting a durability test on the article of manufacture produced;

FIG. 18 is a front elevational view in cross section showing a further form of the backward ironing device used in the pressing operation of FIG. 1, according to a fifth embodiment of the present invention;

FIG. 19 is a fragmentary front elevational view in cross section of a still further form of the backward ironing device used according to a sixth embodiment of the invention;

FIG. 20 is a front elevational view in cross section for explaining the principle of the forward ironing;

DETAILED DESCRIPTION OF THE PREFERRED EMBODIMENTS

Figure 2:
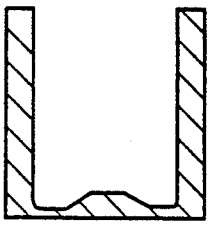
FIG. 2 is a front elevational view in cross section of an article of manufacture produced by the pressing method of FIG. 1.

Referring first to FIGS. 1-11, a pressing method embodying the present invention will be described. The pressing method is practiced by a transfer press system which includes a backward ironing apparatus constructed according to one embodiment of the invention. The transfer press system is adapted to produce a cylindrical container-like article from a sheet of age-hardened or precipitation-hardened stainless steel (JIS SUS 630 or 631) which is classified as austenite stainless steel.

As schematically illustrated in FIG. 1, the pressing method consists of: a blanking step in which a sheet-like blank in the form of a circular disk is prepared by blanking the above-indicated stainless steel sheet which has a thickness of 1.5 mm; four drawing steps for drawing the circular sheet-like blank or disc into a cylindrical intermediate workpiece; a forward ironing step for ironing the cylindrical portion of the workpiece; a backward ironing step for further ironing the cylindrical portion of the workpiece; and an ironing and coining step for finish-ironing and coining the workpiece. The above steps are performed in the order of description to produce a cylindrical container-like article, the nominal dimensions of which are indicated below.

Outside diameter: 8 mm

Radius of curvature of outer corner surface between the cylindrical and bottom portions: 1.5 mm Height: 12 mm The transfer press system includes a blanking apparatus, a drawing apparatus, a forward ironing apparatus and an ironing and coining apparatus, in addition to the backward ironing apparatus. The drawing apparatus, forward ironing apparatus, backward ironing apparatus and ironing and coining apparatus are arranged in a line in the order of description. The workpiece is fed by a work feed device from one of the processing stations corresponding to the apparatuses, to the next station.

The four drawing steps constitute a first process, which is followed by a second process consisting of the forward ironing step and the backward ironing step. In the second process, the backward ironing step follows the forward ironing step.

Figure 3:
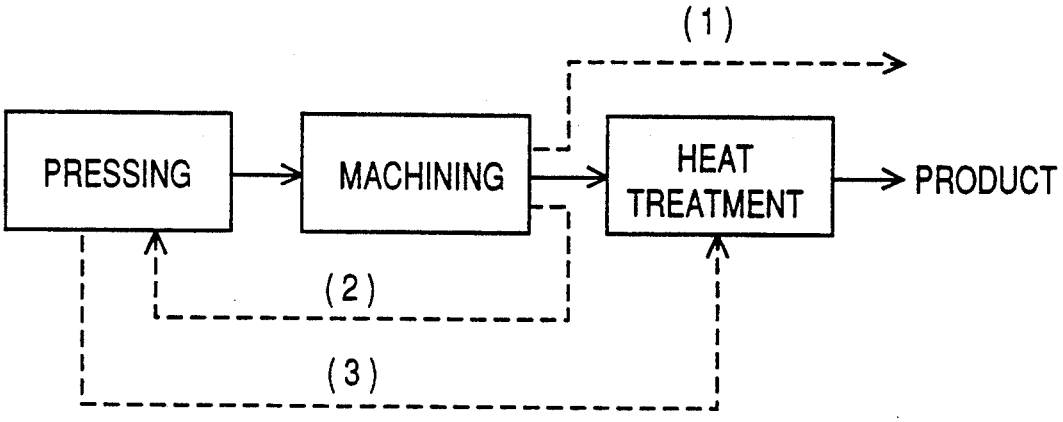
FIG. 3 is a block diagram illustrating a flow of operations including the pressing processes of FIG. 1 and subsequent machining and heat treatment processes to complete the article of FIG. 2.

The cylindrical container-like article produced by the transfer press system is fed to a machining apparatus so that the article is machined at its bottom portion to provide a flat bottom surface, and the machined article is then fed to a heat treatment apparatus so that the article is heat-treated for precipitation hardening. As a result, a final product as shown in FIG. 2 is prepared. Namely, the sheet-like blank is subjected to pressing, machining and heat treatment processes in the order of description, as illustrated in FIG. 3, to manufacture the final product of FIG. 2.

This product manufactured in this specific example is a component of a pressure sensor for sensing the pressure within a combustion chamber of an engine of a motor vehicle. The component consists of a cylindrical portion serving as a housing, and an integral bottom portion which serves as a diaphragm adapted to be displaced in response to the pressure acting thereon. More specifically, an annular section of the bottom portion adjacent to the closed axial end of the cylindrical portion functions as a hinge which permits a central section of the bottom portion to elastically deform in the axial direction of the cylindrical portion. If the cylindrical container-like article produced in the pressing process has a defect at the inner corner surface between the bottom and cylindrical portions, the annular hinge portion of the diaphragm of the final product (component of the pressure sensor) may be damaged or ruptured in use due to stress concentration. To avoid this drawback, the sheet-like blank should be pressed into the cylindrical container-like article, with utmost cares taken to prevent the occurrence of the defect due to an internal space between the inner corner surface of the workpiece (blank) and the correspond corner surface of the ironing punch. In addition, the pressing operation should be performed so as to assure uniform wall thickness of the cylindrical portion of the container-like article, and to avoid aging or delayed crack of the article or the final product.

The pressing, machining and heat treatment processes will be described in detail.

The pressing process will be first described in the order of the blanking step, drawing steps, forward ironing step, backward ironing step, and ironing and coining step.

(A) Blanking Step

This step is effected by the blanking apparatus which is constructed and operated as well known in the art. The details of this apparatus are not deemed essential to understand the principle of the present invention.

In the blanking step, a circular disk (diameter: ΦD) is prepared by blanking from a stainless steel sheet as indicated above, in a manner well known in the art.

(B) Drawing steps

The drawing steps are performed by the drawing apparatus which is constructed and operated as well known in the art.

The first, second, third and fourth drawing steps are effected with different die clearance values as indicated below.

First drawing step: $1.08t_0$

Second drawing step: $0.91t_0$

Third drawing step: $0.94t_0$

Fourth drawing step: $1.04t_0$

The die clearance is a distance between the outer surface of a drawing punch and an inner surface of a die hole, that is, a difference in radius between the diameters of the punch and the die hole. The value "$t_0$" represents the thickness of the stainless steel sheet before blanking.

Die clearance values which are conventionally considered suitable for drawing a soft steel sheet into a cylindrical container-like form are disclosed in "Pressing and Die Technique", p85, Aug. 30, 1990, first edition, first print, Nikkan Kogyo Shinbunsha (Japanese daily newspaper on industry). These die clearance values (hereinafter referred to as "conventional die clearance values") are used for an initial (first) drawing step, an intermediate (second) drawing step and a final (third) drawing step, depending upon the thickness of the sheet, as indicated in TABLE 1 below.

TABLE 1

| CONVENTIONAL DIE CLEARANCE | | | |
|---|---|---|---|
| Sheet Thickness | 1st Drawing | 2nd Drawing | 3rd Drawing |
| ≦0.4 mm | 1.07–1.09 t | 1.08–1.1 t | 1.04–1.05 t |
| 0.4–1.3 mm | 1.08–1.1 t | 1.09–1.12 t | 1.05–1.06 t |
| 1.3–3.2 mm | 1.1–1.12 t | 1.12–1.14 t | 1.07–1.09 t |
| ≧3.2 mm | 1.12–1.14t | 1.15–1.2 t | 1.08–1.1 t |

On the same page of the above-identified literature, there is a footnote stating that the die clearance values for stainless steel sheets, galvanized steel sheets, and tinned iron sheets are 1.1 to 1.3 times the corresponding values for the soft steel sheets in the table. This means that the conventional die clearance values for the stainless steel sheets are usually slightly larger than those for the soft steel sheets. In the present embodiment, however, the die clearance values used for the drawing operations on the stainless steel sheets are selected to be smaller than the conventional die clearance values for the soft steel sheets as indicated in the table. The die clearance values used in the present embodiment were determined in view of the results of experiments conducted to investigate the percentage of aging or delayed crack of the drawn blanks. These results are indicated in TABLE 2.

The significance of the die clearance values used according to the present invention will be described in detail.

Since the thickness $t_0$ of the stainless steel sheet used as the blank is 1.5 mm which falls within the range $1.3–3.2t_0$ in TABLE 1, the conventional die clearance values for the first, second and third drawing steps are as follows:

First (initial) drawing step: $1.1–1.12t_0$

Second (intermediate) drawing step: $1.12–1.14t_0$

Third (final) drawing step: $1.07–1.09t_0$

TABLE 2

| AGING CRACK PERCENTAGE | | | | | | | | | |
|---|---|---|---|---|---|---|---|---|---|
| Process Steps | | First Drawing | Second Drawing | Third Drawing | Fourth Drawing | Fwd. Ironing | Bwd. Ironing | Ironing Coining | Cutting |
| Die Clearance Values | Invention | $1.08\ t_0$ | $0.91\ t_0$ | $0.94\ t_0$ | $1.04\ t_0$ | — | — | — | — |
| | Comparative | $1.10\ t_0$ | $1.12\ t_0$ | $1.12\ t_0$ | $1.07\ t_0$ | — | — | — | — |
| Ironing Percent | | — | — | — | — | 8.9% | 7.5% | 8.3% | — |
| Aging Crack Percent | Invention | 0% | 0% | 0% | 30% | 3% | 0% | 0% | 0% |
| | Comparative | 0% | 100% | 100% | 100% | 70% | — | — | 80% |

The present inventors conducted the following experiment with comparative die clearance values, to inspect the drawn stainless steel sheets for the aging or delayed crack when the die clearance values are set as follows, in the light of the conventional lower limit values of the corresponding ranges in TABLE 1.

First drawing step: $1.1t_0$

Second drawing step: $1.12t_0$

Third drawing step: $1.12t_0$

Fourth drawing step: $1.07t_0$

Namely, the die clearance values for the first and fourth drawing steps to be performed according to the present embodiment are equal to the lower limit values of the first and third ranges indicated in TABLE 1, and those for the second and third drawing steps according to the present embodiment are equal to the lower limit value of the second range in TABLE 1. A first set of testpieces of the stainless steel sheet was subjected to the first drawing step only, and a second set of testpieces was subjected to the successive first and second drawing steps. A third set of testpieces was subjected to the successive first, second and third drawing steps, and a fourth set of testpieces was subjected to the successive first, second, third and fourth drawing steps.

The thus drawn four sets of testpieces as comparative specimens were left in the atmosphere for one week, and inspected for the aging or delayed crack. The percent values of the aging crack of the four sets of comparative specimens are as follows:

First set of testpieces: 0%
Second set of testpieces: 100%
Third set of testpieces: 100%
Fourth set of testpieces: 100%

As also indicated in TABLE 2, none of the testpieces subjected to the first drawing step suffered from the aging crack. However, all the testpieces subjected to the second drawing step (first and second drawing steps) suffered from the aging crack. Similarly, all the testpieces subjected to the third drawing step (first, second and third drawing steps) and all the testpieces subjected to the fourth drawing step (all the four drawing steps) suffered from the aging crack. In this respect, it is noted that none of the testpieces cracked immediately after the drawing in the first, second, third or fourth step, and that all the testpieces of the fourth set, for example, were able to be subjected to all the four drawing steps. The percent values are equal to 100% ×(the number of the testpieces of each set which suffered from aging crack, divided by the total number of the testpieces of the set).

The inventors also conducted an experiment, with the die clearance values indicated below, which are smaller than the conventional values indicated in TABLE 1.

First drawing step: $1.08t_0$
Second drawing step: $0.91t_0$
Third drawing step: $0.94t_0$
Fourth drawing step: $1.04t_0$ As also indicated in TABLE 2, the percent values of the aging crack of the four sets of testpieces are as follows:

First set of testpieces: 0%
Second set of testpieces: 0%
Third set of testpieces: 0%
Fourth set of testpieces: 30%

Thus, only 30% of the testpieces of only the fourth set subjected to the fourth drawing step (first, second, third and fourth steps) suffered from the aging crack. It will therefore be understood that the aging or delayed crack of the drawn testpieces was reduced with the die clearance values smaller than the lower limits of the conventional values indicated in TABLE 1.

It is assumed that the reduction in the aging crack with the reduced die clearance values is derived from a forward ironing action which takes place concurrently with a pure drawing action on the blanks in each of the four drawing steps, because of the use of the die clearance values smaller than the values conventionally considered suitable for the pure drawing operation. It appears that the forward drawing action in each drawing step contributes to reduction in the residual tensile stress within the cylindrical portion of the blanks, which seems to result in reducing the percentage of the aging crack of the drawn testpieces. This presumption is supported by the following fact.

Figure 4:
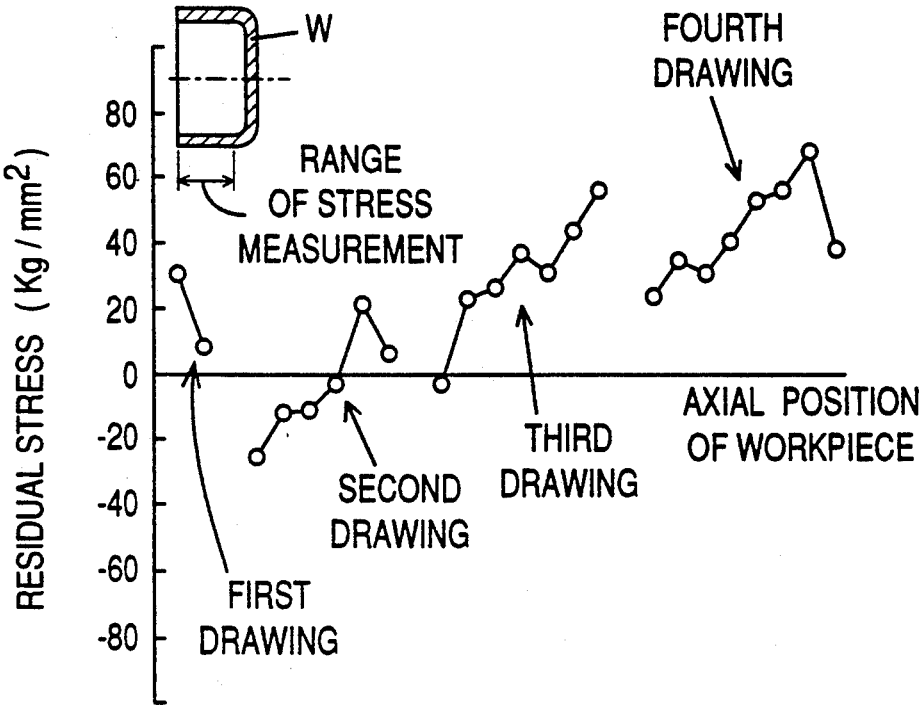
FIG. 4 is a graph indicating an example of distribution of residual stress within an intermediate workpiece after each of four drawing steps performed thereon in the pressing operation of FIG. 1.

The residual stress value of the testpiece after each drawing step was measured on its outer surface. The measured residual stress value is indicated in the graph of FIG. 4, in which a variation in the stress value in the axial direction of the testpiece from its open end toward the closed end is shown from left to right along the horizontal axis of the graph. The graph shows that the residual stress (tensile or compressive) at the open end of the drawn testpiece is sufficiently close to zero.

Further experiments conducted by the present inventors confirmed that the die clearance values suitable for the first, second, third and fourth drawing steps to be performed according to the present invention are 75–99% of the lower limits of the conventional die clearance values indicated in TABLE 1.

(C) Forward Ironing Step

This step is performed by the forward ironing apparatus, which is constructed as well known in the art. The operating principle of the forward ironing action is illustrated in FIG. 20.

In this specific example, the ironing percent (wall thickness reduction percent) in the forward ironing step is set at 8.9% as indicated in TABLE 2. The ironing percent is represented by $[(t_0-t_0)/t_0]\cdot 100\%$ where $t_0$ represents the wall thickness of the cylindrical portion of the container-like workpiece before the forward ironing step, and $t_1$ represents the wall thickness of the cylindrical portion after the forward ironing step.

The significance of the forward ironing percent of 8.9% will become apparent from the following description.

The present inventors conducted an experiment, in which the testpieces subjected to the four drawing steps according to the invention were then subjected to a forward ironing operation with the ironing percent of 8.9%, and with the die hole having a tapered entrance portion whose taper angle $\theta$ is 15° with respect to the axial direction of the workpiece, as indicated in FIG. 20.

Figure 5:
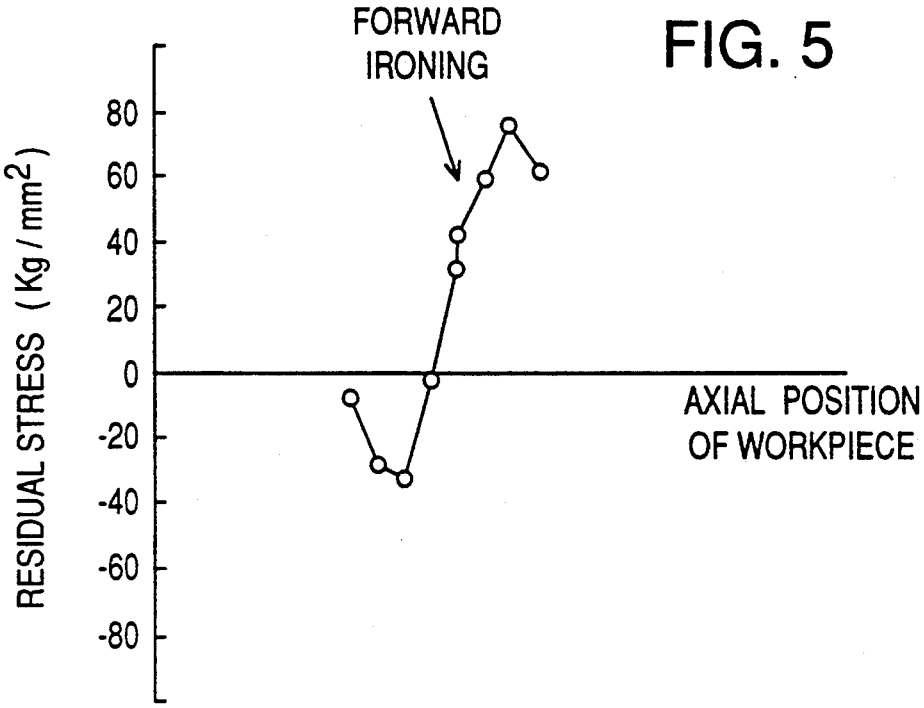
FIG. 5 is a graph indicating an example of residual stress distribution within an intermediate workpiece after a forward ironing step performed thereon in the pressing operation FIG. 1.

The testpieces subjected to the forward ironing step were inspected for the aging crack and the residual stress values. As indicated in TABLE 2, 3% of the testpieces suffered from the aging crack. The residual stress on the outer surface of the testpieces was measured. The distribution of the measured stress values in the axial direction is indicated in the graph of FIG. 5. Under the same conditions, the comparative testpieces drawn with the conventional die clearance values as discussed above were then subjected to the forward ironing operation. As also indicated in TABLE 2, as high as 70% of the comparative testpieces suffered from the aging crack. This aging crack percent is extremely higher than the above value of 3% according to the present invention.

While the taper angle 8 of the entrance portion of the die hole used in the above experiment according to the present embodiment was 15°, which is slightly larger than the taper angle of around 12° usually employed in the conventional ironing operation. This comparatively large taper angle was employed in the present embodiment, for the purpose of minimizing the tensile stress which acts on the cylindrical portion of the workpiece during the forward ironing operation, and for the purpose of reducing the area of contact between the ironing surface of the die hole and the workpiece and accordingly reducing the required ironing force, in view of the comparatively low ironing percent of 8.9%.

The suitable angle of the entrance portion of the die hole with respect to the axial direction of the workpiece ranges from 12° to 20°.

(D) Backward Ironing Step

Figure 6:
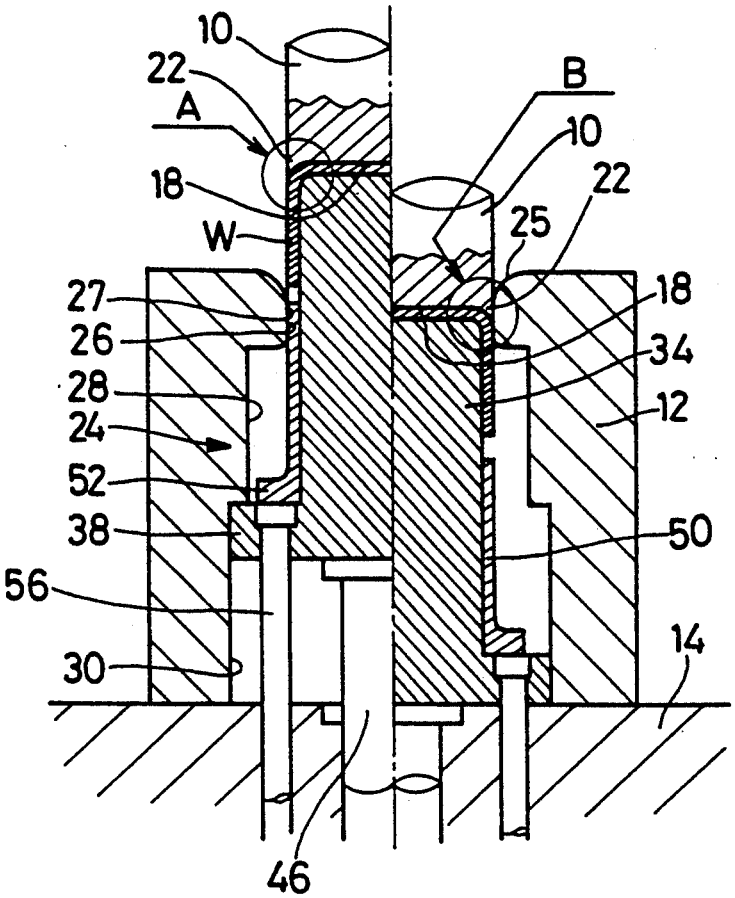
FIG. 6 is a front elevational view in cross section of a device for effecting a backward ironing step in the pressing operation of FIG. 1, according to a first embodiment of this invention.
Figure 24:
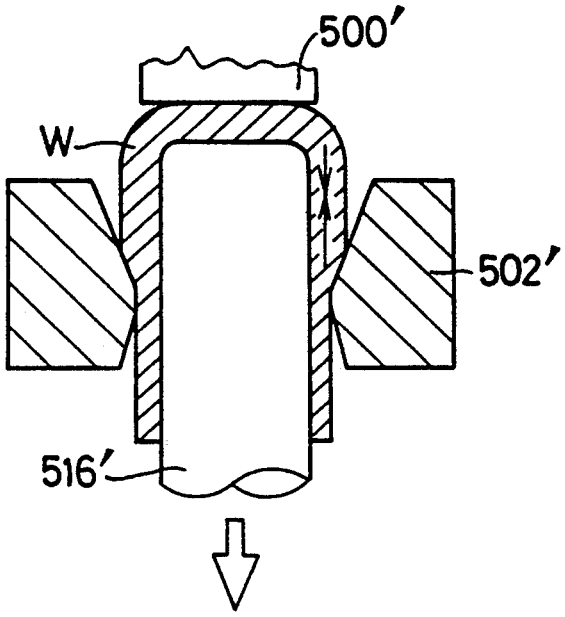
FIG. 24 is a front elevational view in cross section for explaining the principle of the backward ironing.
Figure 25:
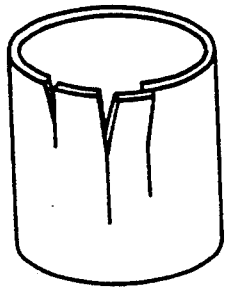
FIG. 25 PRIOR ART
FIG. 25 is a perspective view showing an example of an intermediate workpiece in the form of a cylindrical container made of austenite stainless steel.

This step is performed by the backward ironing apparatus, which is constructed according to the principle of the present invention, as shown in FIG. 6, wherein the left and right halves of the view indicate the operating states immediately after the commencement and before the termination of the backward ironing action, respectively. The principle of the backward ironing operation has been described above by reference to FIG. 24.

Figure 7:
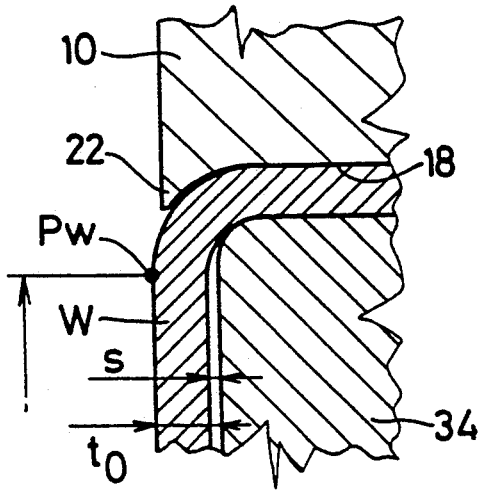
FIG. 7 is an enlarged view showing parts of the device and the workpiece indicated at "A" in FIG. 6.

The backward ironing apparatus is provided with a columnar pushing punch 10 and a die 12. The pushing punch 10 is reciprocated in the axial or longitudinal direction by a suitable drive device not shown, and the die 12 is fixed to a base 14. The pushing punch 10 has a recess 18 formed in its lower end face, as shown in FIG. 7 which shows in enlargement a part A of the view of FIG. 6. The surface (hereinafter referred to as "bottom surface") defining the recess 18 is shaped to closely contact the outer surface of the bottom portion of the container-like workpiece W. The bottom surface of the punch 10 has a central circular flat portion, and a peripheral annular portion which defines and surrounds the central circular flat portion. That is, the pushing punch 10 has an annular projection in the form of a skirt 22 which provides the peripheral annular portion of the bottom surface and which defines the outer circumference of the recess 18. The recess 18 partially defined by the skirt 22 is dimensioned and shaped so that the bottom surface of the punch 10 contacts the outer surface of the bottom portion of the workpiece W and a part of the outer surface of a corner section adjacent to the bottom of the workpiece W. This corner section of the workpiece W is considered a varying-diameter section of the cylindrical portion of the workpiece W, which section connects the bottom portion and a constant-diameter section of the cylindrical portion. The outside diameter of the varying-diameter varies in the axial direction of the workpiece W, while the diameter of the constant-diameter section is constant in the axial direction.

Figure 8:
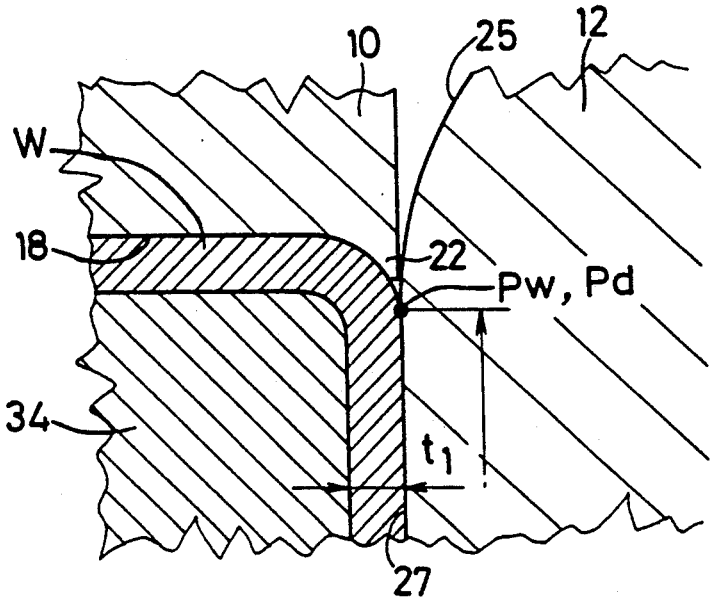
FIG. 8 is an enlarged view showing parts of the device and the workpiece indicated at "B" in FIG. 6.

The die 12 has a stepped die hole 24 which consists of an entrance portion 25, a small-diameter portion 26, an intermediate-diameter portion 28 and a large-diameter portion 30, which are formed in the order of description, from the top to the bottom as seen in FIG. 6. As shown in FIG. 8 which shows in enlargement a part B of FIG. 6, the entrance portion 25 is defined by a curved surface which is contiguous at its lower end with an ironing surface 27 which defines the small-diameter portion 26. The ironing surface 27 is a cylindrical surface coaxial with cylindrical surfaces which define the respective intermediate-diameter and large-diameter portions 28 and 30. Within the die hole 24, there is disposed an ironing punch 34 such that the upper end face of the ironing punch 34 faces the bottom surface (lower end face) of the pushing punch 10. The ironing punch 34 is axially movable relative to the die 12. As shown in FIG. 6, the ironing punch 34 has an outward flange 38 formed at its lower end, which is adapted to abut on the shoulder surface between the intermediate-diameter and large-diameter portions 28, 30. Thus, the outward flange 38 serves as a stop for determining the uppermost position of the punch 34 (indicated in the left half of FIG. 6).

In operation of the backward ironing apparatus of FIG. 6, the container-like intermediate workpiece W (prepared by the drawing steps described above) is placed on the ironing punch 34 such that the upper or trailing end portion of the punch 34 is positioned within the workpiece W, as shown in FIG. 6. The punch 34 cooperates with the ironing surface 27 of the small-diameter portion 26 to iron the cylindrical portion of the workpiece W in the axial direction from the open end toward the closed end. Below the ironing punch 34, a cushion pin 46 is provided for biasing the punch 34 toward its uppermost position.

On the outer circumferential surface of the ironing punch 34, there is slidably fitted a tubular stripper 50, which has an outward flange 52 at its lower end. The outward flange 52 normally rests on the outward flange 38 of the punch 34. Below the outward flange 52, there are provided a plurality of knock-out pins 56 which are movable in the longitudinal direction. The knock-out pins 56 extend at their upper end portion through the outward flange 38, for contact with the outward flange 52 of the stripper 50 placed in its uppermost position indicated in the left half of FIG. 6. After the ironing punch 34 is raised to its uppermost position after the backing ironing action, the knock-out pins 56 are moved upward with their upper ends projecting above the outward flange 38, to push up the stripper 50 relative to the punch 34, whereby the ironed workpiece W is separated from the punch 34 by the stripper 50, as described below. The uppermost position of the stripper 50 is determined by abutting contact of the outward flange 52 with the shoulder surface between the small-diameter and intermediate-diameter portions 26, 28 of the die hole 24.

There will be described the backward ironing operation performed on the backward ironing apparatus of FIG. 6.

The backward ironing operation consists of (1) a first step in which the workpiece W placed on the ironing punch 34 by a gripping finger of the work feed device of the transfer press is pushed down together with the ironing punch 34, by a downward movement of the pushing punch 10, to force the workpiece W into the die hole 24, to iron the entire length of the cylindrical portion of the workpiece W, from the uppermost position indicated in the left half of FIG. 6 to the lowermost position indicated in the right half of FIG. 6, and (2) a second step in which the pushing punch 10, ironing punch 34, etc. are moved up from the lowermost position to the uppermost position, and the knock-out pins 56 are moved up to separate the workpiece W from the punch 34. The second step is referred to as the backward ironing action.

Before the backward ironing operation is started, the pushing punch 10 is placed at its rest or non-operated position which is a suitable distance above the position indicated in the left half of FIG. 6. At this time, the ironing punch 34 is located at its uppermost position also indicated in the left half of FIG. 6, while the stripper 50 is positioned such that its upper end is aligned with the upper end face of the punch 34 or located a short distance above the upper end face of the punch 34. This arrangement prevents the lower end of the workpiece W to collide with the upper end of the ironing punch 34 when the workpiece W is positioned right above the punch 34 by a horizontal movement of the workpiece by the gripping finger which is moved in the horizontal plane by the work feed device of the transfer press. The intermediate workpiece w transferred from the forward ironing apparatus by the work feed device is positioned by the gripping finger such that the lower end of the workpiece W is in contact with the upper end of the stripper 50.

After the initial positioning of the workpiece W with respect to the ironing punch 34 is completed, the backward ironing step is initiated with a downward movement of the pushing punch 10. After the lower end of the pushing punch 10 abuts on the bottom portion of the workpiece W, the punch 10 is further moved down together with the workpiece W relative to the ironing punch 34. As a result, the workpiece W is fitted on the upper or trailing end portion of the punch 34. In this condition, a suitable clearance S is left between the outer circumferential surface of the ironing punch 34 and the inner circumferential surface of the cylindrical portion of the workpiece W, as shown in FIG. 7. In other words, the dimensions of the workpiece W and the ironing punch 34 determined so as to provide the inner clearance S facilitate the positioning of the workpiece W on the ironing punch 34.

With a further downward movement of the pushing punch 10, the movement of the punch 10 is imparted to the upper end of the punch 34 through the bottom portion of the workpiece W. When the force of the punch 10 which acts on the ironing punch 34 exceeds a sum of the biasing force of the cushion pin 46 and relatively small reaction forces of the knock-out pins 56, the pushing and ironing punches 10, 34, workpiece W, stripper 50, and cushion and knock-out pins 46, 56 are moved down as a unit. The biasing force of the cushion pin 46 is determined to be sufficient for the upper end of the ironing punch 34 to be in close contact with the inner surface of the bottom portion of the workpiece W.

The movement of the workpiece W with the ironing punch 34 relative to the ironing surface 27 of the die 12 causes the cylindrical portion of the workpiece W to be ironed while being squeezed between the ironing surface 27 and the outer circumferential surface of the punch 34. The backward ironing action proceeds in the axial direction of the workpiece W, from the open end toward the closed end of the cylindrical portion. Since the recess 18 is formed in the lower end face of the pushing punch 10 as shown in FIG. 7, as described above, the material of the workpiece W which flows from the open end portion toward the closed end portion during the backward ironing action is restricted by the skirt or annular peripheral projection 22 of the punch 10, whereby the varying-diameter section of the workpiece W between the bottom portion and the constant-diameter section is protected against outward buckling or bending due to an axial compressive force which acts on the cylindrical portion of the workpiece W.

The pushing punch 10 is moved down until the lower end of the ironing punch 34 comes into abutting contact with the upper surface of the base 14, which serves as a stop for determining the lowermost position of the punch 34 indicated in the right half of FIG. 6. Thus, the backward ironing action is terminated, without an internal space left between the inner corner surface of the workpiece W and the outer corner surface of the ironing punch 34, which would arise from the buckling at the varying-diameter section of the workpiece, in the absence of the recess 18 formed on the pushing punch 10 so as to control the material flow. Accordingly, the pushing punch 10 having the recess 18 (skirt 22) permits the outer corner surface of the ironed workpiece W to follow the annular surface of the skirt or annular projection 22, as shown in FIG. 8, at the end of the backward ironing action.

When the ironing punch 34 has been brought into abutting contact at its lower end with the upper surface of the base 14, the upper end (indicated at Pw in FIGS. 7 and 8) of the constant-diameter section of the cylindrical portion of the ironed workpiece W is aligned with the upper end (indicated at Pd in FIG. 8) of the ironing surface 27, i.e., the lower end of the entrance portion 25. However, the upper end Pw may be located slightly below the upper end Pd of the ironing surface 27 at the end of the ironing action. This arrangement permits the entire axial length of the cylindrical portion of the workpiece W to be ironed by one downward movement of the pushing punch 10 (ironing punch 34).

Figure 21:
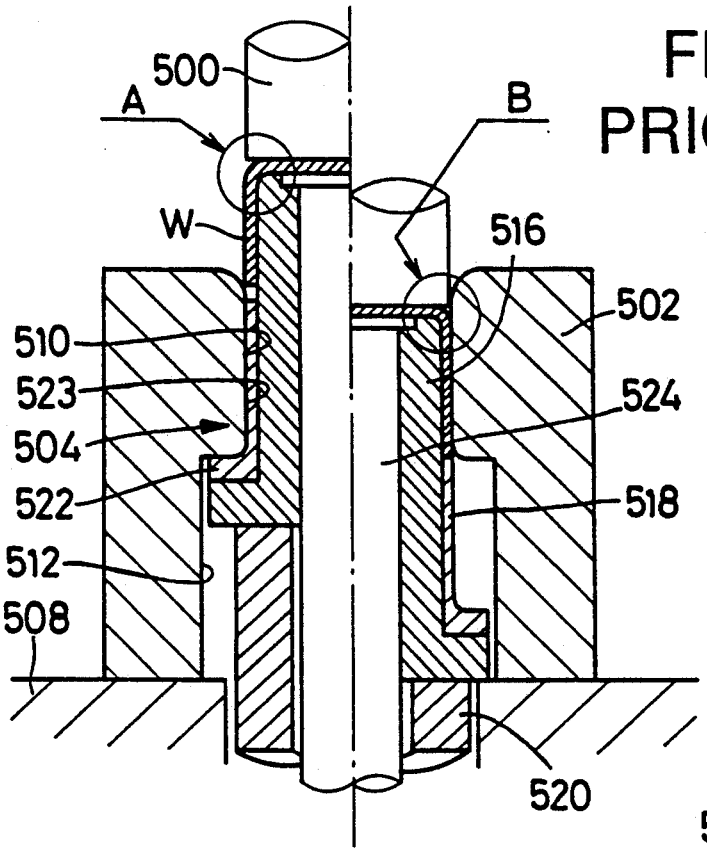
FIG. 21 PRIOR ART
FIG. 21 is a front elevational view in cross section of a known backward ironing device.
Figure 22:
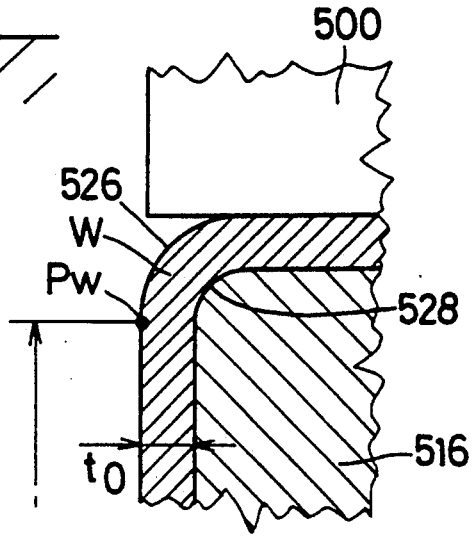
FIG. 22 PRIOR ART
FIG. 22 is a fragmentary front elevational view in cross section showing parts of the device and the workpiece indicated at "A" in FIG. 21.
Figure 23:
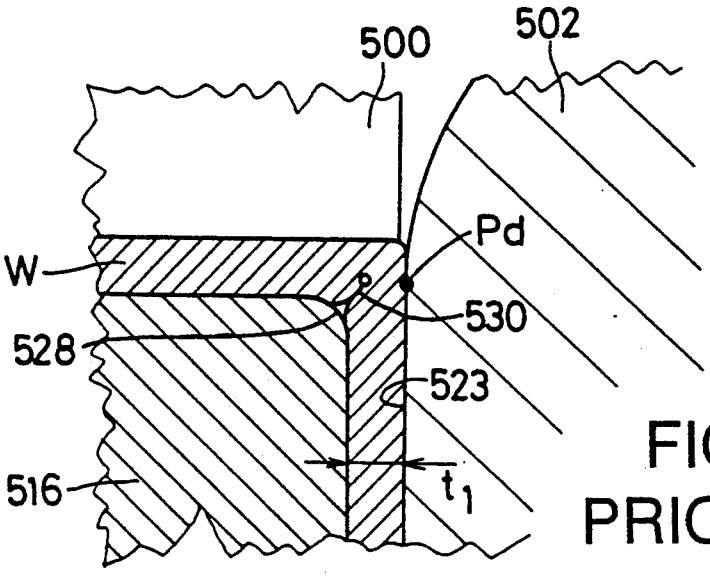
FIG. 23 PRIOR ART
FIG. 23 is a fragmentary front elevational view in cross section showing parts of the device and workpiece indicated at "B" in FIG. 21.

Unlike the sleeve 518 used in the known backward ironing apparatus shown in FIG. 21, the stripper 50 used in the present apparatus is not adapted pressing contact with the lower end face of the workpiece W at the end of the backward ironing action, and does not have a function of defining or determining the height dimension of the ironed cylindrical portion of the workpiece W. In the present embodiment, the stripper 50 merely functions to remove the ironed workpiece W from the ironing punch 34. Although FIG. 6 shows a considerable spacing existing between the lower end of the workpiece W and the upper end of the stripper 50, for exaggeration to explain the above functional difference between the stripper 50 and the sleeve 518, the upper end of the stripper 50 is in fact almost in contact with the lower end of the workpiece W at the end of the backward ironing action.

Upon completion of the backward ironing action as described above, the pushing punch 10 is raised to its rest or non-operated position, whereby the ironing punch 34, workpiece W, etc. are moved up as a unit by the biasing action of the cushion pin 46, until the flange 38 of the punch 34 comes into abutting contact with the shoulder surface between the intermediate-diameter and large-diameter portions 28, 30 of the die hole 24. Thus, the ironing punch 34 is returned to its uppermost position indicated in the left half of FIG. 6, Then, the knock-out pins 56 are moved up by a suitable drive device, to push up the stripper 50 relative to the ironing punch 34 held in its uppermost position, whereby the workpiece W is removed from the punch 34. In this way, the backward ironing operation is completed.

Figure 9:
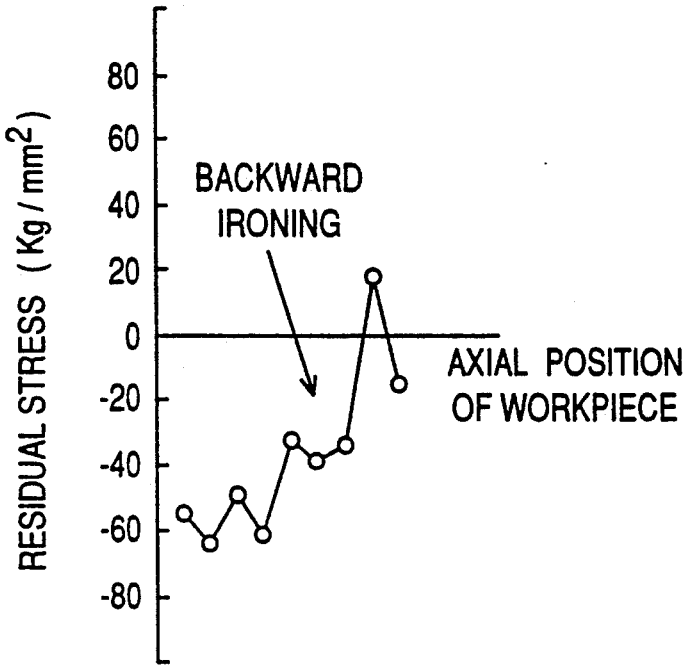
FIG. 9 is a graph indicating an example of residual stress distribution within an intermediate workpiece after the backward ironing step.

Testpieces subjected to the backward ironing operation as described above were inspected for the aging crack and the residual stress. As indicated in TABLE 2, none of the testpieces suffered from the aging crack. The distribution of the residual stress measured on the testpieces is shown in the graph of FIG. 9, which shows a considerably large magnitude of the residual compressive stress at or near the open end of the ironed cylindrical portion of the workpiece, and over the almost entire length of the ironed cylindrical portion. If a large residual tensile stress remained near the open end of the ironed cylindrical portion, aging crack would be likely to occur beginning at the open end.

Figure 11:
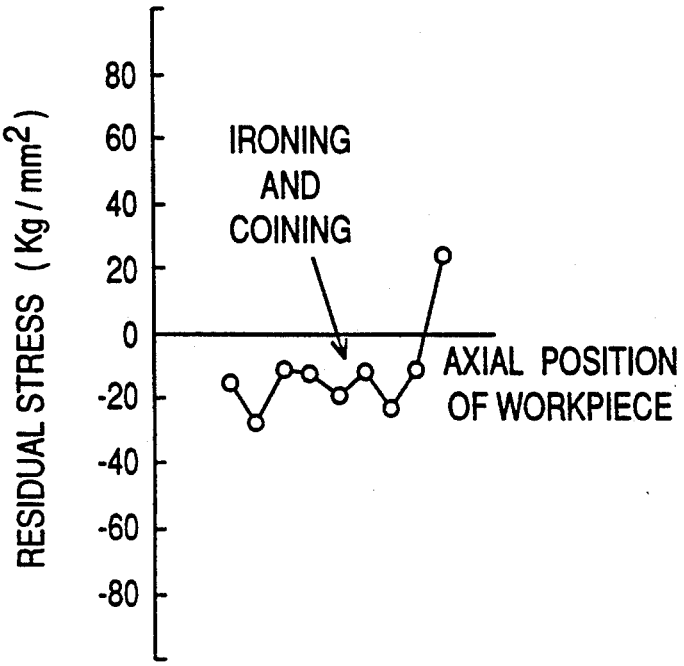
FIG. 11 is a graph indicating an example of residual stress distribution within the workpiece after the ironing and coining step.

Usually, a workpiece or blank subjected to an ironing operation (whether forward or backward) suffers from "earing" at the open end face, namely, formation of scallops or ears around the top edge of the ironed workpiece due to misalignment between the workpiece and the die and due to difference in the directional properties (anisotropy) of the material of the workpiece. Therefore, the open end of the ironed workpiece does not have a completely flat face or edge perpendicular to the axial direction, and tends to have uneven residual stress in the circumferential direction. More specifically, the circumferential region having the largest axial length (height dimension) tends to have a tensile stress rather than a compressible stress, than the circumferential region having the smallest axial length. When the open end portion of the cylindrical portion of the workpiece W is ironed, the ironing surface 27 of the die 12 cannot impart a compressible stress to the highest circumferential region, since the material does not exist at the circumferential regions of the ironing surface 27 which are adjacent to the highest region of the workpiece in the circumferential direction. In view of this tendency, the residual stress as indicated in the graphs of FIGS. 5, 9 and 11 was measured at the circumferential position of the ironed cylindrical portion of the workpiece W, at which the lowest circumferential region is located and at which the residual compressible stress is the largest.

The workpiece W thus subjected to the backward ironing step and removed from the punch 34 is held by the gripping finger and transferred to the next station, for the ironing and coining step by the ironing and coining apparatus.

(E) Ironing and Coining Step

Figure 10:
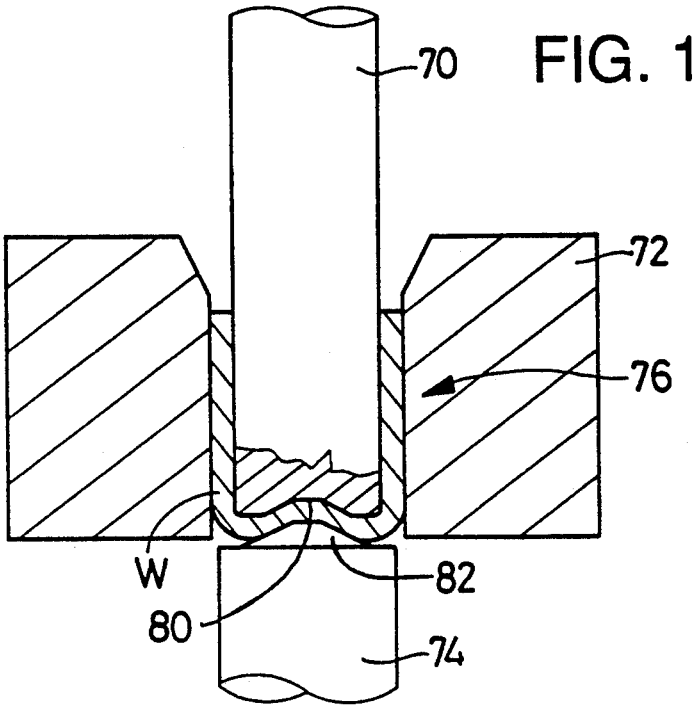
FIG. 10 is a front elevational view in cross section of a device for ironing and coining the workpiece in the pressing operation of FIG. 1.

The ironing and coining apparatus is constructed as shown in FIG. 10.

This apparatus is adapted to perform a coining operation as well as a forward ironing operation on the workpiece W which has been subjected to the backward ironing operation. The apparatus includes a movable ironing punch 70 reciprocated in the axial direction, a stationary die 72, and a stationary coining punch 74. In operation, the workpiece W is fitted on the leading end portion of the ironing punch 70, and the punch 70 is moved down to force the workpiece W into a die hole 76 formed through the die 72. The ironing surface provided by the die hole 76 cooperates with the outer surface of the ironing punch 70 to iron the cylindrical portion of the workpiece W, in the axial direction from the closed end toward the open end. Shortly before the forward ironing action is terminated, the bottom portion of the workpiece W is forced by the ironing punch 70, against the upper end of the coining punch 70. The ironing punch 70 has a recess 80 formed in its lower end face, while the coining punch 74 has a protrusion 82 formed on its upper end face, so that the recess 80 and the protrusion 82 cooperate with each other to shape the bottom portion of the workpiece W, such that the central section of the bottom portion is raised inward of the workpiece in the axial direction.

In the present embodiment, the forward ironing in the ironing and coining step was effected with an ironing percent of 8.3%, and none of the testpieces suffered from the aging crack, as indicated in TABLE 2. The residual stress measured on the cylindrical portion of the testpieces is indicated in the graph of FIG. 11. Although the ironing and coining step includes a forward ironing action which causes a residual tensile stress, the residual stress is a compressive one over the entire axial length of the ironed cylindrical portion of the workpiece, as indicated in FIG. 11. Further, as is apparent from the graphs of FIGS. 9 and 11, the ironing and coining step provided effective reduction in the difference between the maximum and minimum residual stress values, from as large as about 80 kg/mm$^2$ (FIG. 9) before the ironing and coining operation, to as small as about 50 kg/mm$^2$ (FIG. 11) after the ironing and coining operation. In this connection, it is noted that the bottom portion of the workpiece W has a higher degree of rigidity, and a smaller amount of dimensional change upon subsequent heat treatment than the cylindrical portion. If the residual stress value of the bottom portion is removed from consideration of the above difference, the difference (i.e., variation of the residual stress in the axial direction) after the ironing and coining operation is about 20 kg/mm$^2$, which is only ¼ of that before the ironing and coining operation.

Thus, the pressing process performed by the transfer press system is completed. The cylindrical container-like intermediate workpiece subjected to the pressing process is then transferred from the transfer press system to the machining apparatus, so that the bottom portion of the workpiece W is machined flat at its outer surface. As a result, the bottom wall of the workpiece W has a raised central portion having a convex inner surface, and a thin-walled annular peripheral portion which surrounds the raised central portion.

A machining operation on the workpiece W may cause partial or local elastic deformation, which results in reducing the residual compressive stress on the surface of the workpiece (due to release of the compressive stress by means of the elastic deformation). Consequently, the machined workpiece W may crack. However, since the workpiece W before the machining operation has a sufficiently large residual compressive stress, none of the testpieces suffered from the aging crack after the machining step, as also indicated in TABLE 2.

TABLE 2 also indicates as high as 80% aging crack of the comparative testpieces which were subjected to the conventional drawing operation, a forward ironing operation with the ironing percent of 8.9% and a machining operation. In an experiment conducted on the comparative testpieces, some of the testpieces cracked immediately after the forward ironing operation, and therefore only the non-cracked testpieces were subjected to the machining operation. The 80% of the machined testpieces had the aging crack.

The machined workpiece W is then heat-treated for precipitation hardening. Described in detail, the workpiece W is introduced into a furnace and held there at about 500° C. for one hour, to improve the mechanical properties of the workpiece W such as the hardness and strength. Thus, the final product is obtained by the series of process steps described above.

There will next be described advantages of the individual process steps.

(i) Advantage of the drawing steps

Since the die clearance values used are smaller than the conventional values, the workpiece is not only drawn but also concurrently ironed, whereby the drawn workpiece has a constant wall thickness at its cylindrical portion, with improved accuracy of the inside and outside diameters. Further, the drawing steps according to the invention greatly contribute to the elimination of the aging crack of the drawn workpiece.

Usually, a drawn workpiece tends to be strain-hardened and have a residual tensile stress. Since the strain hardening is heavier at and near the open end of the drawn workpiece, the aging crack is commonly generated starting at the open end. In the conventional drawing method, therefore, the blank to be drawn is prepared with a larger size with respect to the nominal axial dimension of the final product, and the strain-hardened open end portion of the workpiece is cut off by trimming after completion of each drawing step or between successive drawing steps. In the present embodiment of the invention, however, it is not essential to effect such trimming step for removing the strain-hardened open end portion which causes the aging crack and which is hard to process. Accordingly, the yield ratio of the workpiece W (e.g., expensive precipitation-hardened stainless steel) can be improved, and the required total number of the process steps and the cost of the production equipment can be significantly reduced. Although the use of the smaller die clearance values than the conventional values increases the load acting on the dies and shorten the life of the dies according to the present embodiment, an increase in the cost of the dies due to their shorter service life can be sufficiently counterbalanced by an overall decrease in the production cost owing to the improved yield ratio of the workpiece, reduced number of the process steps and shortened production time.

(ii) Advantage of the forward ironing step

This forward ironing step effected with a sufficiently high ironing percent assures uniform wall thickness and high accuracy of the inside and outside diameters and improved surface smoothness of the ironed cylindrical portion of the workpiece W, and permits increased strength of the workpiece due to the strain hardening, while preventing an internal space left between the inner corner surface and the outer corner surface of the ironing punch at the end of the ironing action.

(iii) Advantage of the backward ironing step

Since this backward ironing step is effected with a lower ironing percent than in the forward ironing step, the amount of the material flow from the open end toward the closed end of the cylindrical portion of the workpiece W is accordingly reduced. Further, the recess 18 formed in the operating end face of the pushing punch 10 is effective to prevent buckling or bending at the varying-diameter section of the ironed cylindrical portion of the workpiece W. The lower ironing percent and the recess 18 cooperate to assure complete elimination of the formation of an internal space along the inner corner surface of the ironed workpiece, and give the ironed cylindrical portion a residual compressive stress, which assures complete freedom of the ironed workpiece from the aging or delayed crack. The ironed workpiece has a substantially constant wall thickness at its cylindrical portion, and is effectively protected from the aging crack even if the workpiece is made of a precipitation-hardened stainless steel similar to an austenite stainless steel material.

In the conventional backward ironing apparatus shown in FIG. 21, the workpiece W subjected to the backward ironing action is removed from the ironing punch 516, by the eject pin 524 which is adapted to push the bottom portion of the workpiece, such that the upper end portion of the eject pin 524 extends above the end face of the ironing punch 516. The removed workpiece W is supported by the eject pin 524, with the bottom portion resting on the upper end of the pin 524. In this condition, the workpiece W is gripped by the gripping finger and transferred to the next station. To transfer the workpiece W, the gripping finger should be first elevated to remove the workpiece from the eject pin 524, and then moved in the horizontal direction to transfer the workpiece to the apparatus in the next station. Thus, the gripping finger should be adapted to move in the vertical direction as well as in the horizontal direction, to prevent a collision of the cylindrical portion of the workpiece with the eject pin 524 when the workpiece is transferred to the next station. Accordingly, the work feed device including the gripping finger is large-sized and complicated in structure, with a result of increasing the cost of the transfer press system.

In the backward ironing apparatus shown in FIG. 6 used in the present embodiment, on the other hand, the annular stripper 50 slidably fitted on the outer circumference of the ironing punch 34 is used to remove the ironed workpiece W from the ironing punch 34. The workpiece W removed from the punch 34 rests on the stripper 50 such that the upper open end face of the workpiece W is in contact with the upper end face of the stripper 50. Further, when the stripper 50 is in the uppermost position, the upper end of the ironing punch 34 is flush or level with, or lower than the upper end of the stripper 50. Therefore, the gripping finger is required to provide only a horizontal movement of the workpiece W when the workpiece is fed to the backward ironing apparatus from the drawing apparatus, or to the ironing and coining apparatus from the backward ironing apparatus. Since the work feed device including the gripping finger does not require a mechanism to move the workpiece in the vertical direction, the cost of the transfer press system is accordingly lowered.

In the present embodiment, the ironing surface 27 provided by the small-diameter portion 26 of the die hole 24 has a considerably short axial length, as compared with the ironing surface 523 of the die hole 504 of the die 502 used in the conventional apparatus of FIG. 21. While the axial length of the ironing surface 523 is larger than that of the workpiece W, the axial length of the ironing surface 27 is considerably smaller than that of the workpiece, as is apparent from FIG. 6. In the conventional apparatus of FIG. 21, the axial length of contact of the workpiece W with the ironing surface 523 increases up to its entire axial length as the ironing operation progresses. In the present apparatus of FIG. 6, the axial length of contact of the workpiece with the ironing surface 27 is constant (equal to the short axial length of the ironing surface 27) after the lower end of the workpiece passes the lower end of the ironing surface 27. Therefore, the ironing force required in the present apparatus of FIG. 6 is considerably smaller than that required in the conventional apparatus of FIG. 21, whereby the required capacity of the backward ironing apparatus is accordingly reduced.

(iv) Advantage of the ironing and coining step

Since the axial variation or difference of the residual stress on the outer surface of the workpiece W is sufficiently small after the ironing and coining step as discussed above, the releasing of the residual stress in the subsequent machining and heat treatment operations does not cause a significant amount of change in the inside and outside diameters of the machined and heat-treated workpiece. In other words, a relatively even distribution of the residual stress in the axial direction of the ironed and coined workpiece permits the subsequent machining and heat treatment steps to be effected with an effectively reduced amount of change in the outside and inside diameters of the final product.

Further, the die hole 76 which does not have a land permits the workpiece W to be coined such that the entire length of the cylindrical portion is restricted by the cylindrical surface of the die hole 76. This arrangement permits concurrent ironing of the cylindrical portion and coining of the bottom portion, without an increase in the outside diameter of the ironed cylindrical portion due to the plastic flow of the material. Thus, the ironing and coining operation assures improved accuracy of the inside and outside diameters of the ironed cylindrical portion, and high accuracy of shaping of the inner and outer surfaces of the coined bottom portion.

(v) Advantage of the machining step

For the reasons explained above, the workpiece W is not susceptible to cracking even if the workpiece is machined immediately after the pressing process (ironing and coining step). This means that it is not necessary to perform an annealing step (generally, solution heat treatment under vacuum) between the pressing and machining processes, to remove the residual strain. The elimination of such annealing step accordingly reduces the production efficiency. If the precipitation-hardened workpiece W prepared by the pressing process were annealed before the machining step, the mechanical properties given to the workpiece in the drawing operation would be more or less lost in the annealing step, and an additional step is required to restore the desired mechanical properties of the workpiece. This drawback is not present in the present embodiment which does not require such an annealing step between the pressing and machining processes.

(vi) Advantage of the heat treatment step

Since the dimensional accuracy of the workpiece W has been improved in the pressing process before the machining step, the amount of strain or distortion of the workpiece to be caused by the heat treatment is extremely small, and its variation is also small. Therefore, the heat-treated workpiece W is available as the final product.

(vii) Advantage of the overall process

If the drawing operation is followed by the forward ironing operation and the ironing and coining operation, the residual stress within the processed workpiece W tends to be in the form of a tensile stress which causes the workpiece to easily suffer from the aging crack. In the present embodiment, however, the drawing operation is effected with die clearance values smaller than the conventional values, so that the drawing operation involves a concurrent ironing action as well as a drawing action. Further, the forward ironing step is followed by the backward ironing step which is followed by the ironing and coining step. The backward ironing operation provides a sufficient reduction in the residual stress generated in the drawing and forward ironing processes, and the subsequent ironing and coining operation permits the residual stress to be a residual compressive stress which is substantially evenly distributed over the entire axial length of the workpiece. The present arrangement is therefore effective to prevent the aging crack of the workpiece or final product. That is, the backward ironing operation is effective to prevent the aging crack of the workpiece, irrespective of whether the backward ironing operation is effected immediately after or before the drawing, forward ironing or ironing and coining operation which causes an increase in the residual stress (tensile stress) at the open end portion of the workpiece.

In addition, the individual pressing operations, the machining operation and the heat treatment operation may be performed at different locations (mutually distant factories or different sites within the same factory) and/or at different times, if needed, since virtually no aging crack will occur on the intermediate workpiece at any stage of production, i.e., after a given step in the pressing process, after the entire pressing process or after the machining step.

Even if the transfer press system is stopped for a long time due to a trouble with the pressing apparatus, dies, etc., the workpiece will not have the aging crack. conventionally, the workpieces which actually cracked or are expected to crack during the breakdown of the press system should be removed from the production line. In this respect, the present embodiment of the invention assures high yield ratio of the workpiece and improved production efficiency. If necessary, the individual pressing operations such as drawing and ironing steps may be performed on different pressing machines not in a transfer press line or system, and at different times.

Figure 12:
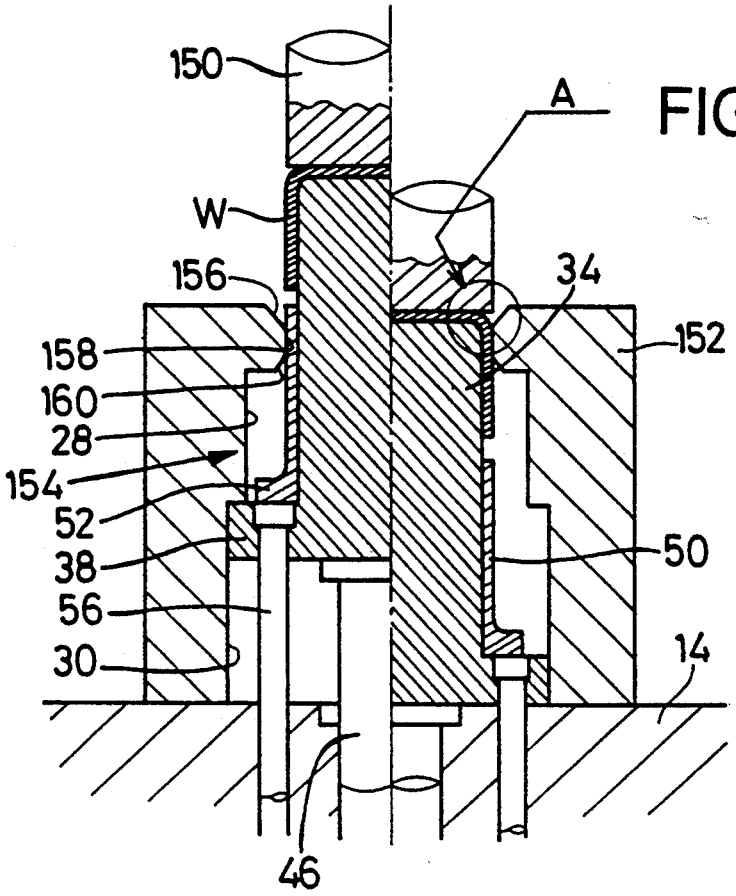
FIG. 12 is a front elevational view in cross section showing another form of the device for effecting the backward ironing step according to a second embodiment of the invention.

Referring next to FIGS. 12 and 13, there will be described a second embodiment of this invention which uses a backward ironing apparatus different from that of FIG. 6 used in the first embodiment, in the shape of the operating or lower end of the pushing punch and the configuration of the die hole.

The backward ironing apparatus of FIG. 12 uses a pushing punch 150 whose lower end has a flat face as indicated in FIG. 13, which shows in enlargement a part A of FIG. 12 when the backward ironing action has just finished. The apparatus uses a die 152 having a die hole 154 which consists of an upper tapered portion 156, a land portion 158 which provides a cylindrical ironing surface, a lower tapered portion 160, an intermediate-diameter portion 28 and a large-diameter portion 30.

In the backward ironing step performed on the apparatus of FIG. 6, the axial movement of the workpiece W and the ironing punch 34 into the die hole 24 is terminated when the upper axial end (indicated at Pw in FIGS. 8 and 13) of the constant-diameter section of the cylindrical portion of the workpiece W (which end Pw is adjacent to the entrance portion 25) has reached or passed the lower axial end (indicated at Pd in FIGS. 8 and 13) of the ironing surface 27 (which end Pd is adjacent to the constant-diameter section of the workpiece) at which the backward ironing action is initiated. One dot-chain line in FIG. 13 shows the position in which the the axial end Pw of the constant-diameter section of the workpiece W is aligned with the lower axial end Pd of the upper ironing surface 156 (namely, the upper axial end of the land portion or ironing surface 158). In the present backward ironing step performed on the apparatus of FIG. 12, the movement of the workpiece W and the ironing punch 34 is terminated when the upper axial end Pw of the constant-diameter section of the workpiece has reached a position a predetermined distance "L" above the lower axial end Pd of the upper tapered portion 156 or the upper axial end Pd of the land portion or ironing surface 158, as indicated in solid line in FIG. 13. In other words, when the workpiece W is placed in its lowermost position at which the backward ironing operation is terminated, the upper end Pw of the constant-diameter section is located the predetermined distance "L" above the upper end Pd of the land portion 156. This distance "L" is determined by an experiment, so that an internal space is not left or formed between the inner corner surface of the varying-diameter section of the workpiece W and the corresponding outer corner surface of the ironing punch 34, when the backward ironing action or the downward movement of the workpiece is terminated at its lowermost position.

In the present second embodiment, the time at which the backward ironing action is terminated or the lowermost axial position of the workpiece at which the ironing movement of the workpiece is terminated is determined so as to prevent the formation of the above-indicated internal space along the inner corner surface of the workpiece at the end of the backward ironing operation, rather than the recess 18 is formed in the operating lower end face of the pushing punch 10 so as to restrict or control the material flow of the workpiece as in the first embodiment of FIG. 6.

The ironing and coining step may be effected by an apparatus as shown in FIG. 10, which is constructed and used according to a third embodiment of this invention.

Like the ironing and coining apparatus of FIG. 10, the apparatus of FIG. 14 used in this third embodiment has an ironing punch 200, a stationary coining punch 202 and a die 204. However, the die 204 has a die hole 206 which is different from the die hole of the die 72 of FIG. 10. The die hole 206 includes a land portion 208 which provides a forward ironing surface, and an OD binding portion 210 which functions to restrict the cylindrical portion of the workpiece W. The OD binding portion 210 is adapted to contact the leading or lower end part of the ironed cylindrical portion of the workpiece before and while the bottom portion is forced against the coining punch 202. The OD binding portion 210 prevents a change in the outside diameter of the lower end part of the cylindrical portion due to a coining action on the bottom portion.

Since the area of the ironing surface provided by the land portion 208 of the die hole 206 of the die 204 is smaller than that of the ironing surface of the die 72 of FIG. 10, the required forward ironing force is reduced, whereby the workpiece W and the die 204 do not suffer from galling or sticking, and fouling or seizure.

The inside diameter of the OD binding portion 210 is equal to or slightly smaller than the inside diameter of the land portion 208. The OD binding portion 210 may be defined by a cylindrical or tapered surface. While the OD binding portion 210 is formed as an integral part of the die 204, a suitable separate member having an OD binding surface may be fixed to the die 204 so that the OD binding surface partially defines the die hole 206.

The ironing and coining apparatus of FIG. 10 or 14 may be replaced by an apparatus as shown in FIG. 15, which is constructed and used according to a fourth embodiment of the invention.

Unlike the apparatus of FIG. 14, the ironing and coining apparatus of FIG. 15 used in the fourth embodiment does not have the OD binding portion 210, and a movable coining punch **202*a* instead of the stationary coining punch 202. In this embodiment, the movable coining punch 202*a* is adapted to cooperate with the ironing punch 200 to start coining the bottom portion of the workpiece W almost when the ironing action by the land portion 208 is initiated at the lower end of the cylindrical portion of the workpiece W. As the workpiece W is lowered by the ironing punch 200 to iron the cylindrical portion, the coining punch 202*a* is lowered with the ironing punch 200 such that the coining force which is produced by the ironing and coining punches 200, 202*a*** and which acts on the bottom portion is increased, so that the coining operation to form the bottom portion of the workpiece to the desired shape is terminated when the ironing action over the entire length of the cylindrical portion is almost completed.

In the above embodiments, the forward and backward ironing operations are effected with a single reciprocation of the workpiece W to perform a single ironing action. However, two or more ironing actions may be performed in one or both of the forward and backward ironing steps.

In the illustrated embodiments, the drawing process, the forward ironing step and the backward ironing step are effected in the order of description. However, another backward ironing step may be inserted between the drawing process and the forward ironing step, provided this backward ironing step does not cause the formation of an internal space along the inner corner surface of the workpiece W at the end of the backward ironing action. For instance, this backward ironing step may be effected with a considerably low ironing percent (low thickness reduction ratio), or applied to only the open end region of the cylindrical portion of the workpiece. The backward ironing step prior to the forward ironing step makes it possible to perform the forward ironing step with a higher ironing percent than in the illustrated embodiment, to further improve the uniformity of the wall thickness of the ironed cylindrical portion of the workpiece W, while preventing the aging crack of the workpiece or final product. If the backward ironing step is performed prior to the forward ironing step, the backward ironing step following the forward ironing step as described above may be eliminated. In this case, too, the aging crack of the workpiece may be prevented to a sufficient extent.

In the embodiments described above, the machined workpiece is heat-treated since the blank is made of a precipitation-hardened material. The final product shown in FIG. 2 produced from the workpiece W is used in a combustion chamber of an engine, at a normal operating temperature in the neighborhood of 300°-500° C. The present inventors recognized a possibility that the heat treatment step in the process of production of the final product may be replaced by the initial use at the elevated temperature in the engine combustion chamber, and conducted an experiment to investigate a change in the durability of the product with or without the in-process heat treatment, in an attempt to confirm that the heat treatment step may be eliminated without a decrease in the durability of the final product.

The experiment was conducted on testpieces A which were heat-treated, and testpieces B which were not heat-treated. The testpieces A and B were exposed to 350° C. (lowest temperature in the actual operating environment) and 500° C. (highest temperature in the operating environment) in the air, and subjected to a repeated oscillation test by using a device shown in FIG. 16. More specifically, each testpiece A, B was fixed to a fixture 300 such that a projection provided on the fixture 300 is fixedly inserted in the open end portion of the testpiece. In this condition, the bottom wall of the testpiece A, B was oscillated by an oscillator 304 via a ball 302 interposed between the outer surface of the bottom wall of the testpiece and the oscillator 304 such that the ball 302 is in contact with a central part of the bottom wall.

Figure 17:
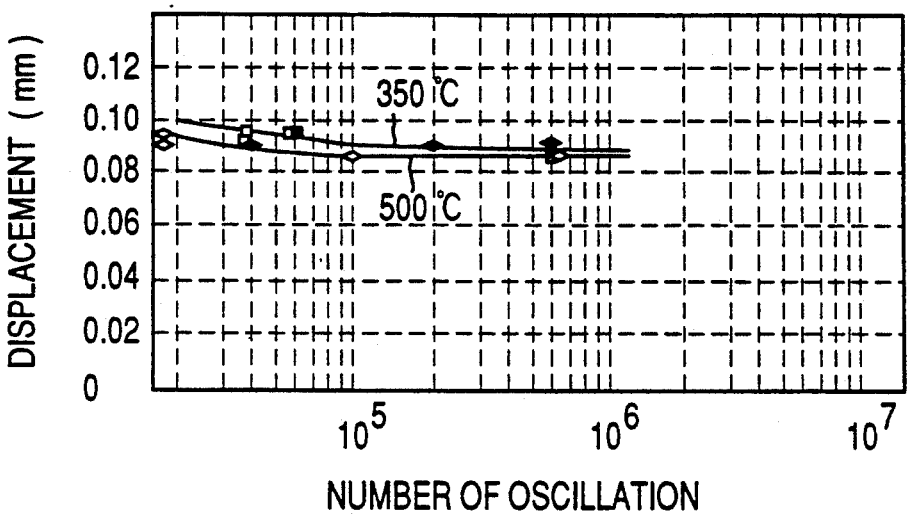
FIG. 17 is a view indicating a result of the durability test.

The amount of displacement of the bottom wall of the testpieces A, B measured in the above experiment is indicated in the graph of FIG. 17, in relation to the number of oscillation of the oscillator 304. It will be understood from the graph that there is not a significant difference in the result of the test between the heat-treated testpieces A and the non-heat-treated testpieces B. Thus, the experiment confirmed as expected that the machined workpiece W without the heat treatment step is able to fulfil the intended function of the final product. The elimination of the heat treatment step which requires the longest time of all the process steps results in a further increase in the production efficiency and a further decrease in the cost of manufacture of the final product.

In the above embodiments, the pressing process, the machining step and the heat treatment step are effected in the order of description, as indicated by solid-line arrows in FIG. 3. The above experiment proved that the final product may be obtained by the pressing process followed by only the machining step, as indicated by dashed-line arrow (1) in FIG. 3. Alternatively, the machining step is followed by the pressing process as indicated by dashed-line arrow (2), so that the processing process (selected steps) and the machining step are again effected, and the heat treatment step is finally effected. The second pressing process is possible because the intermediate workpiece was given a sufficient compressive stress in the first pressing process, which contributes to prevent the aging crack of the final product. In the second pressing process, it is desirable to effect the forward ironing step and the subsequent steps, or the backward ironing step and the ironing and coining step, and preferable to avoid the drawing steps since the drawing steps tend to increase the residual tensile stress of the workpiece.

While the final product produced according to the above embodiments requires as essential steps the machining operation and the heat treatment (in-process treatment or during the use in the operating environment), the principle of the present invention is equally applicable to a blank made of a material which can be heat-treated immediately after the pressing step, as indicated by dashed-line arrow (3) in FIG. 3. The present invention is also applicable to the production of a final product which requires only the drawing steps and the forward and ironing steps and does not require the ironing and coining step on the workpiece.

Reference is now made to FIG. 18, which shows a backward ironing apparatus constructed according to a fifth embodiment of this invention. While the apparatus of FIG. 18 uses the same pushing punch 10 having the recess 18 and the skirt 22 as provided on the apparatus of FIG. 6, the apparatus of FIG. 18 is different in various aspects from that of FIG. 6.

Unlike the apparatus of FIG. 6, the present apparatus of FIG. 18 uses a shaft 310 in place of the cushion pin 46. The shaft 310 is reciprocated in the longitudinal direction by a suitable drive device. Since the shaft 310 is screwed or otherwise fixed at its upper end to the lower end portion of the ironing punch 34, the punch 34 is moved with the shaft 310. The die 12 has a die hole 312 consisting of an entrance portion 313, a cylindrical small-diameter portion 314 and a cylindrical large-diameter portion 316, which are formed from the top to the bottom in the order of description. The small-diameter portion 314 provides a cylindrical ironing surface 318.

As indicated in FIG. 18, the die 12 consists of a plurality of separate members. The die 12 of FIG. 6 may be similarly constructed. Described in detail, the die 12 includes a generally cylindrical body 320, an ironing member 322, and a fixing member 324. The ironing member 322 defines the entrance and small-diameter portions 313, 314 of the die hole 312, and is removably fixed to the fixing member 324. The fixing member 324 is secured to the body 320 such that the small-diameter portion 314 is coaxial with the large-diameter portion 316 provided by the body 320, and also coaxial with the pushing punch 10. Of these constituent members 320, 322, 324 of the die 12, only the ironing member 322 is made of a carbide or other hard metallic material. The other members 320, 324 are made of a material having an ordinary hardness value.

The operation of the backward ironing apparatus of FIG. 18 is basically identical with that of the apparatus of FIG. 6, except for the manner of positioning the workpiece W on the ironing punch 34 and the manner of removing the ironed workpiece W from the punch 34.

Before the ironing operation is initiated, the stripper 50 is in the uppermost position in which the flange 52 is held in contact with the lower surface of the ironing member 322, by the knock-out pins 56. In this condition, the ironing punch 34 is held by the shaft 310, in the position indicated in the left half of FIG. 18, in which the upper end face of the punch 34 is flush with or slightly below the upper end of the stripper 50 in its uppermost position.

With the stripper 50 and the punch 34 held in the positions described above, the workpiece W held by the gripping finger is positioned right above the ironing punch 34, and the punch 34 is elevated by the shaft 310, so that the upper end portion of the punch 34 is inserted into the workpiece W until the end face of the punch 34 comes into abutting contact with the inner surface of the bottom portion of the workpiece W. Then, the pushing punch 10 is lowered until the lower end of the punch 10 abuts on the outer surface of the bottom portion of the punch 10. When the force of the pushing punch 10 which acts on the workpiece in the downward direction exceeds the force of the shaft 310 which acts on the punch 34 in the upward direction, the workpiece W, punch 34, shaft 310, stripper 50 and knock-out pins 56 are moved down as a unit with the pushing punch 10. During this movement of the workpiece W, its cylindrical portion is ironed in the axial direction from the lower open end toward the upper closed end. Eventually, the ironing punch 34 reaches its lowermost position indicated in the right half of FIG. 18, at which the backward ironing action is terminated.

In the present backward ironing apparatus, too, the cylindrical portion of the workpiece W is ironed over its entire axial length by the ironing surface 318, with the ironing area being shifted from the open end toward the closed end of the workpiece.

Upon completion of the backward ironing action at the position indicated in the right half of FIG. 18, the pushing punch 10 is first raised, and the ironing punch 34, workpiece W, stripper 50 and knock-out pins 56 are moved up by the shaft 310. The pushing punch 10 is finally returned to its non-operated position, while the ironing punch 34 and the stripper 50 are returned to their uppermost positions.

With the stripper 50 held in its uppermost position by the knock-out pins 56, the shaft 310 is lowered with the ironing punch 34, whereby the punch 34 is separated from the ironed workpiece W, and the workpiece W remains on the stripper 50, with the lower end face of the workpiece W in contact with the upper end face of the stripper 50. The workpiece W is then gripped by the gripping finger of the work feed device, and transferred to the next station.

Unlike the apparatus of FIG. 6 in the first embodiment wherein the workpiece W is removed from the punch 34 by moving up the stripper 50 relative to the punch 34 held in its uppermost position, the apparatus according to this fifth embodiment is adapted to remove the workpiece W by moving down the punch 34 relative to the stripper 50 held in its uppermost position. In the apparatus of FIG. 6, the workpiece W is removed from the punch 34 by an upward force applied to the workpiece by the stripper 50, and the workpiece may leap on the stripper 50 and may be misaligned with the stripper 50 at the moment of separation of the lower end portion of the workpiece from the upper end of the punch 34. The misalignment of the workpiece W relative to the stripper 50 may lead to a failure of the gripping finger to grip the workpiece. In the present apparatus of FIG. 18, a downward force is applied to the workpiece W so as to force the workpiece W against the stripper 50 when the punch 34 is lowered to remove the workpiece from the punch 34. This arrangement permits accurate alignment of the workpiece W relative to the stripper 50 after the workpiece W is separated from the punch 34.

Referring next to FIG. 19, there will be described a backward ironing apparatus constructed according to a sixth embodiment of the present invention. This apparatus of FIG. 19 uses a pushing punch 340 in place of the pushing punch 10 used in the embodiments of FIGS. 6 and 18. The pushing punch 340 is used with the ironing punch 34, and a die 346 in place of the die 12 used in the embodiments of FIGS. 6 and 18. In FIG. 19, the die 346 is indicated in two-dot chain line.

The pushing punch 340 is a columnar hollow member having a larger outside diameter than the outside diameter of the workpiece W, and a center bore 341 having a diameter considerably smaller than the inside diameter of the workpiece W. The pushing punch 340 has an annular recess 342 formed in its lower end face. With this annular recess 342 formed, the pushing punch 340 has an annular lower end surface 344 whose inner edge is defined by the recess 342. As shown in FIG. 19, the surface defining the annular recess 342 is a generally arcuate surface which extends between the edge of the center bore 341 and the inner edge of the annular lower end surface 344. The generally arcuate surface defining the recess 342 is formed to closely contact an outer corner surface of the workpiece W, that is, an outer peripheral portion of the outer surface of the bottom portion of the workpiece W, and the outer surface of the varying-diameter section of the cylindrical portion of the workpiece, which varying-diameter section connects the bottom portion and the constant-diameter section of the cylindrical portion.

Unlike the pushing punch 10 used in the apparatus of FIG. 6, the pushing punch 340 having the larger diameter than the workpiece W cannot be moved into a die hole 348 of the die 346. The pushing punch 340 and the die 346 are designed so that the lower end surface 344 of the punch 340 does not contact the top surface of the die 346 when the punch 340 has reached its lowermost end at which the backward ironing action is terminated. FIG. 19 shows the position of the punch 340 in its lowermost position in which the lower end surface 344 is located a short distance above the top surface of the die 346.

Unlike the die hole 24 or 312 of the die 12, the die hole 348 includes an upper tapered portion 350 whose diameter increases in the downward direction, a land portion 352 which provides a cylindrical ironing surface, and a lower tapered portion 354 whose diameter decreases in the downward direction. A knock-out pin 356 is inserted through the center bore 341 such that the pin 356 is movable relative to the punch 340 in the longitudinal direction. The knock-out pin 356 functions to remove the workpiece W from the pushing punch 340, after the workpiece W is ironed with its outer corner surface held in close contact with the annular recess 342 of the punch 340.

In the present sixth embodiment wherein the surface defining the recess 342 is adapted to closely contact the corner portion of the outer surface of the workpiece W, the outer corner surface of the ironed workpiece W is shaped following the shape of the recess 342. In other words, the outer corner surface of the workpiece can be shaped as desired, with comparatively high degree of freedom and accuracy, by suitably shaping the annular recess formed in the lower end face of the punch 340.

While the pushing punch 10, 340 is positioned above the ironing punch 34, the positional relationship of these punches may be reversed. Further, the axes of these pushing and ironing punches 10, 340, 34 and the die 12, 346 may be horizontal or inclined at a suitable angle with respect to the vertical or horizontal plane. Where the pushing punch 10, 340 is positioned below the ironing punch 34, gravity may be favorably utilized to remove the workpiece W from the ironing punch 34.

In the illustrated embodiments of FIGS. 6, 12, 18 and 19, the axial length of the ironing surface or land portion 27, 158, 318, 352 of the die hole 24, 154, 312, 348 is shorter than that of the cylindrical portion of the workpiece W to be ironed, with a design emphasis placed on the generation of a residual compressive stress within the ironed cylindrical portion of the workpiece, for the purpose of preventing the aging crack of the ironed workpiece or final product. The above design arrangement is less suitable for improving the accuracy of the axial length of the ironed cylindrical portion of the workpiece, as compared with the arrangement of FIG. 21 in which the axial length of the ironing surface of the die 523 of the die hole 504 is substantially equal to or larger than that of the cylindrical portion of the workpiece. For improved accuracy of the axial length or height of the ironed workpiece, it is possible to use a die which has an ironing surface whose axial length is large enough to cover the axial length of the cylindrical portion portion of the workpiece W.

In the illustrated embodiments, the ironing percent values used in the forward and backward ironing steps and in the ironing and coining step are in the neighborhood of 8%. However, the principle of the present invention may be applicable to an ironing operation to be performed with an ironing percent or wall thickness reduction ratio which is considerably close to zero. In this case, the ironing action merely reduces the outside and inside diameters of the cylindrical portion of the workpiece, with substantially no reduction or only a small amount of reduction in the wall thickness of the cylindrical portion. For such ironing operation, the present invention may be effective to prevent not only the aging crack of the ironed workpiece but also the formation of an internal space left between the inner and out corner surfaces of the ironed workpiece and the ironing punch. In the ironing operation with no or small wall thickness reduction, the ironing force is relatively small, and the service life of the lubricant used between the inner die hole surface and the outer workpiece surface is comparatively prolonged.

It is to be understood that the present invention is not limited to the details of the illustrated embodiments which have been described above by way of example, and that the invention may be embodied with various changes, modifications and improvements, which may occur to those skilled in the art, without departing from the spirit and scope of the invention defined in the following claims.

What is claimed is:

1. A method of pressing a sheet-like blank into a tubular container, including a first process in which the sheet-like blank is drawn into an intermediate workpiece having a tubular portion and a bottom portion which closes one of opposite axial ends of the tubular portion, and a second process in which said tubular portion of said intermediate workpiece is ironed in an axial direction thereof, said second process comprising:

a forward ironing step for placing said intermediate workpiece on a columnar first ironing punch such that at least a leading end portion of said first ironing punch is positioned within said intermediate workpiece, and forcing said intermediate workpiece and said first ironing punch together into a first die hole, to iron said tubular portion of the workpiece in an axial direction from said one of said opposite axial ends of said tubular portion, toward the other of said opposite axial ends; and a backward ironing step for placing said intermediate workpiece on a columnar second ironing punch such that at least a trailing end portion of said second ironing punch is positioned within said intermediate workpiece, and forcing said intermediate workpiece and said second ironing punch together into a second die hole, with a columnar pushing punch held in pressing contact at one end thereof with an outer surface of said bottom portion of said intermediate workpiece remote from the trailing end portion of said second ironing punch, to iron said tubular portion of the workpiece in an axial direction from said other of said opposite axial ends of said tubular portion toward said one of said opposite axial ends.

2. A method according to claim 1, wherein said tubular container is a cylindrical container, and said tubular portion consists of a cylindrical portion which is circular in shape in transverse cross section, and wherein said first ironing punch, said second ironing punch, said first die hole, said second die hole and said pushing punch are circular in shape in transverse cross section.

3. A method according to claim 1, wherein said first process comprises ironing said sheet-like blank while drawing said sheet-like blank, and said forward ironing step in said second process precedes said backward ironing step, and wherein an ironing percent in said forward ironing step is larger than that in said backward ironing step, said ironing percent being expressed by $[(t_0-t_1)/t_0]\cdot 100\%$, where $t_0$ and $t_1$ represent wall thickness values of said tubular portion before and after said tubular portion is ironed, respectively.

4. A method according to claim 1, wherein said sheet-like blank consists principally of a material susceptible to aging crack, which is selected from a group comprising austenite stainless steel, brass, high-tension steel, and high-tension aluminum alloys.

5. A method according to claim 1, wherein said first process comprises a plurality of drawing steps all of which are effected with a radial die clearance not larger than $1.10t_0$, at least one of said drawing steps being effected with the radial die clearance not larger than $1.00t_0$, where $t_0$ represents at thickness of said sheet-like blank.

6. A method according to claim 1, wherein said first die hole is formed in a first die which has a tapered entrance portion which defines one of opposite end portions of said first die hole through which said intermediate workpiece and said first ironing punch enter said first die hole, said tapered entrance portion having a taper angle of 12–20° with respect to a center line of said first die hole.

7. A method according to claim 1, further including a third process in which said tubular portion of said intermediate workpiece is further ironed and said bottom portion is coined.

8. A method according to claim 7, wherein said third process includes a coining step in which said bottom portion of the intermediate workpiece is coined while at least an end portion of said tubular portion adjacent to said bottom portion is held under pressure by and between an ironing punch and a die.

9. A method according to claim 7, wherein said third step includes a coining step in which a central section of said bottom portion of said intermediate workpiece is embossed with respect to an outer peripheral section surrounding said central section, in an axial direction of said tubular portion, toward an interior of said tubular portion, by an amount smaller than a wall thickness of said bottom portion.

10. A method according to claim 9, wherein said bottom portion of said intermediate workpiece which has been subjected to said third process is machined at an outer surface of said outer peripheral section, to reduce a wall thickness of said outer peripheral section to a value smaller than that of said embossed central part, so that the machined outer peripheral section and said central part cooperate to provide a diaphragm of a pressure sensing component.

11. A method according to claim 1, wherein said pushing punch used in said backward ironing step has a recess formed in an end face at said one end thereof, said backward ironing step being performed such that a surface defining said recess closely contacts said outer surface of said bottom portion of said intermediate workpiece, and a portion of an outer surface of said tubular portion of said intermediate workpiece which is adjacent to said outer surface of said bottom portion.

12. A method according to claim 1, wherein said tubular portion of said intermediate workpiece includes a constant-diameter section whose diameter is constant in said axial direction, and a varying-diameter section whose diameter varies in said axial direction and which connects said constant-diameter section and said bottom portion, said second die hole being partially defined by an ironing surface which cooperates with said second ironing punch to effect said backward ironing step, and wherein a movement of said intermediate workpiece and said second ironing punch in said axial direction in said backward ironing step is terminated before an end of said constant-diameter section on the side of said bottom portion has reached one of opposite axial ends of said ironing surface at which an ironing operation in said backward ironing step is initiated.

13. A method according to claim 1, wherein said second ironing punch has an outside diameter smaller than an inside diameter of said tubular portion of said intermediate workpiece, so that a clearance is left between said second ironing punch and said tubular portion when said intermediate workpiece is fitted on said second ironing punch.

14. An apparatus for ironing a tubular blank having a tubular portion and a bottom portion which closes one of opposite axial ends of said tubular portion, said apparatus including a columnar ironing punch, a die having a die hole having an ironing surface, and a columnar pushing punch, said ironing punch having an outer surface which cooperates with said ironing surface of said ironing die to iron said tubular portion of said tubular blank in an axial direction of said tubular portion from the other of said opposite ends toward said one of said opposite axial ends, such that said tubular blank placed on said ironing punch with at least a trailing end portion of said ironing punch being positioned within said tubular blank is forced together with said ironing punch into said die hole, with said pushing punch held in pressing contact at one end thereof with an outer surface of said bottom portion of said tubular blank remote from said trailing end portion of said ironing punch, wherein the improvement comprises:

said pushing punch having a recess formed in an end face at said one end thereof, said recess being defined by a surface which is formed to closely contact said outer surface of said bottom portion of said tubular blank, and a portion of an outer surface of said tubular portion of said tubular blank which is adjacent to said outer surface of said bottom portion.

15. An apparatus according to claim 14, wherein said tubular portion of said tubular blank consists of a cylindrical portion circular in shape in transverse cross section, and wherein said ironing punch, said die hole and said pushing punch are circular in shape in transverse cross section.

16. An apparatus according to claim 14, wherein said tubular portion of said tubular blank includes a constant-diameter section whose diameter is constant in said axial direction, and a varying-diameter section whose diameter varies in said axial direction and which connects said constant-diameter section and said bottom portion, and wherein said surface defining said recess is formed to closely contact said outer surface of said bottom portion of said tubular blank and an outer surface of said varying-diameter section of said tubular portion.

17. An apparatus according to claim 16, wherein said recess has an arcuate shape in transverse cross section taken in a plane including an axial center line of said tubular blank.

18. An apparatus according to claim 16, wherein said die hole has an entrance portion whose diameter decreases in said axial direction from said one of said opposite ends toward the other of said opposite axial ends, and a constant-diameter portion which has a constant diameter in said axial direction and which provides said ironing surface, said apparatus further including a stop for limiting a distance of movement of said ironing punch into said die hole, so as to prevent a boundary of said constant-diameter section and said varying-diameter section of said tubular portion of said tubular blank from moving past one of opposite axial ends of said ironing surface at which an ironing operation on said blank is initiated.

19. An apparatus according to claim 18, wherein constant-diameter portion includes a land portion which is defined by said ironing surface.

20. An apparatus according to claim 14, wherein said die has an entrance portion whose diameter decreases in said axial direction from said one of said opposite ends toward the other of said opposite axial ends, and a constant-diameter portion as said ironing surface which has a constant diameter in said axial direction, said pushing punch having an annular projection which defines an outer circumference of said recess, said annular projection being moved into said entrance portion in a terminal period of an ironing operation on said blank.

21. An apparatus according to claim 14, wherein said pushing punch has an annular portion which defines an outer circumference of said recess, said apparatus further including a stop for limiting a distance of movement of said ironing punch into said die hole, so as to provide a clearance between an end face of said annular portion and an end face of said die facing said annular portion, at the end of an ironing operation on said blank.

22. An apparatus according to claim 14, further including a tubular stripper fitted on an outer surface of said ironing punch, said stripper acting on an end face of said tubular blank remote from said pushing punch, to separate said tubular blank from said ironing punch, after an ironing operation on said blank is finished.

23. An apparatus according to claim 14, further including a drive member to which said ironing punch is fixed, and a drive device for reciprocating said drive member in opposite axial directions parallel to an axial center line of said ironing punch.

24. A method of ironing a tubular portion of a tubular blank having a bottom portion closing one of opposite axial ends of said tubular portion, by cooperation of an outer surface of an ironing punch and an ironing surface of a die hole, such that said tubular blank placed on said ironing punch is forced together with said ironing punch into said die hole, with a pushing punch held in pressing contact at one end thereof with an outer surface of said bottom portion of said tubular blank remote from said ironing punch, to iron said tubular portion of said tubular blank in an axial direction thereof from the other of said opposite axial ends of said tubular portion toward said one of said opposite axial ends, said tubular portion of said tubular blank including a constant-diameter section whose diameter is constant in said axial direction, and a varying-diameter section whose diameter varies in said axial direction and which connects said constant-diameter section and said bottom portion, said method comprising the step of:

terminating a movement of said tubular blank and said ironing punch into said die hole before an end of said constant-diameter section on the side of said bottom portion has reached one of opposite axial ends of said ironing surface at which an ironing operation on said tubular portion in said axial direction is initiated.

* * * * *